US011271319B2

(12) United States Patent
Celik

(10) Patent No.: US 11,271,319 B2
(45) Date of Patent: Mar. 8, 2022

(54) ANTENNAS FOR RECEPTION OF SATELLITE SIGNALS

(71) Applicant: Trimble Inc., Sunnyvale, CA (US)

(72) Inventor: Nuri Celik, Milpitas, CA (US)

(73) Assignee: Trimble Inc., Sunnyvale, CA (US)

( * ) Notice: Subject to any disclaimer, the term of this patent is extended or adjusted under 35 U.S.C. 154(b) by 176 days.

(21) Appl. No.: 16/436,720

(22) Filed: Jun. 10, 2019

(65) Prior Publication Data

US 2020/0388929 A1 Dec. 10, 2020

(51) Int. Cl.

| | |
|---|---|
| ***H01Q 13/18*** | (2006.01) |
| ***H01Q 1/48*** | (2006.01) |
| ***H01Q 1/38*** | (2006.01) |
| ***H01Q 21/06*** | (2006.01) |
| ***H01Q 1/24*** | (2006.01) |
| ***H01Q 1/52*** | (2006.01) |

(52) U.S. Cl.

CPC ..... *H01Q 13/18* (2013.01); *H01Q 1/247* (2013.01); *H01Q 1/38* (2013.01); *H01Q 1/48* (2013.01); *H01Q 1/528* (2013.01); *H01Q 21/065* (2013.01); *H01Q 1/246* (2013.01)

(58) Field of Classification Search

CPC ..... H01Q 1/247; H01Q 1/48; H01Q 13/18

See application file for complete search history.

(56) References Cited

U.S. PATENT DOCUMENTS

| | | | |
|---|---|---|---|
| 4,208,660 | A | 6/1980 | McOwen, Jr. |
| 5,714,961 | A | 2/1998 | Kot et al. |
| 6,262,495 | B1 | 7/2001 | Yablonovitch et al. |
| 6,597,316 | B2 | 7/2003 | Rao et al. |
| 6,847,328 | B1 | 1/2005 | Libonati et al. |
| 7,436,363 | B1 | 10/2008 | Klein et al. |
| 7,446,712 | B2 | 11/2008 | Itoh et al. |
| 7,994,997 | B2 | 8/2011 | Livingston et al. |

(Continued)

FOREIGN PATENT DOCUMENTS

| | | | |
|---|---|---|---|
| JP | WO2014108977 | A1 | 7/2014 |
| WO | 2016/109403 | A1 | 7/2016 |

(Continued)

OTHER PUBLICATIONS

The Extended European Search Report for Application No. 21168395.8-1205, dated Jul. 2, 2021, 8 pages.

(Continued)

*Primary Examiner* — Daniel Munoz

(74) *Attorney, Agent, or Firm* — Kilpatrick Townsend and Stockton LLP

(57) ABSTRACT

An antenna configured to receive radiation at global navigation satellite system (GNSS) frequencies includes a substrate, a frontside patch arranged on a front side of the substrate, and a metamaterial ground plane. The metamaterial ground plane includes a plurality of backside patches and a cavity. The plurality of backside patches include a center backside patch surrounded in a radial direction by a plurality of intermediate backside patches. The center backside patch and the plurality of intermediate backside patches are arranged in a pattern that provides circular symmetry with respect to a center of the antenna. The cavity is coupled to the substrate, and the plurality of intermediate backside patches are electrically isolated from the cavity.

19 Claims, 24 Drawing Sheets

(56) References Cited

U.S. PATENT DOCUMENTS

| | | | | |
|---|---|---|---|---|
| 8,610,635 | B2 | 12/2013 | Huang et al. | |
| 9,184,504 | B2 | 11/2015 | Tatarnikov et al. | |
| 9,590,314 | B2 | 3/2017 | Celik | |
| 10,181,646 | B2 * | 1/2019 | Celik | H01Q 5/40 |
| 10,197,679 | B2 * | 2/2019 | Astakhov | H01Q 9/0407 |
| 10,381,732 | B2 * | 8/2019 | Celik | H01Q 9/0464 |
| 10,505,279 | B2 * | 12/2019 | Celik | H01Q 9/0428 |
| 10,826,183 | B2 * | 11/2020 | Celik | H01Q 5/40 |
| 2004/0080455 | A1 | 4/2004 | Lee | |
| 2007/0052587 | A1 | 3/2007 | Cheng | |
| 2007/0285324 | A1 | 12/2007 | Waterhouse et al. | |
| 2008/0042903 | A1 | 2/2008 | Cheng | |
| 2008/0204326 | A1 | 8/2008 | Zeinolabedian Rafi et al. | |
| 2010/0060535 | A1 | 3/2010 | Tiezzi et al. | |
| 2010/0090903 | A1 | 4/2010 | Byun et al. | |
| 2014/0028524 | A1 | 1/2014 | Jerauld et al. | |
| 2015/0123869 | A1 | 5/2015 | Bit-Babik | |
| 2016/0164182 | A1 | 6/2016 | Lai et al. | |
| 2016/0190704 | A1 * | 6/2016 | Celik | H01Q 9/0435 343/700 MS |
| 2017/0033468 | A1 | 2/2017 | Wong | |
| 2018/0191073 | A1 | 7/2018 | Celik | |
| 2018/0205151 | A1 | 7/2018 | Celik | |
| 2019/0074592 | A1 | 3/2019 | Celik | |

FOREIGN PATENT DOCUMENTS

| | | | |
|---|---|---|---|
| WO | 2018/125670 | A1 | 7/2018 |
| WO | 2018/136421 | A1 | 7/2018 |

OTHER PUBLICATIONS

Amiri, M. et al., "Analysis, Design, and Measurements of Circularly Symmetric High-Impedance Surfaces for Loop Antenna Applications," IEEE Transactions on Antennas and Propagation, vol. 64, No. 2, Feb. 1, 2016, pp. 618-629.

Amiri, M. et al., "Gain and Bandwidth Enhancement of a Spiral Antenna Using a Circularly Symmetric HIS," IEEE Antennas and Wireless Propagation Letters, vol. 16, Oct. 27, 2016, pp. 1080-1083.

Bian et al., "Wideband circularly polarised slot antenna," IET Microwaves, Antennas & Propagation, vol. 2, No. 5, Aug. 4, 2008, pp. 497-502, XP006031283; doi: 10.1049/iet-map:20070243.

Boyko, S. N. et al., "EBG Metamaterial Ground Plane Application for GNSS Antenna Multipath Mitigating," 2015 International Workshop on Antenna Technology (IWAT), IEEE, Mar. 4, 2015, pp. 178-181.

Grelier, M. et al., "Axial ratio improvement of an Archimedean spiral antenna over a radial AMC reflector," Applied Physics A Materials Science & Processing, Nov. 10, 2012, vol. 109, No. 4, pp. 1081-1086.

Jensen et al., "Coupled Transmission Lines as Impedance Transformer" IEEE Transactions on Microwave Theory and Techniques, vol. 55, No. 12, Dec. 2007, 9 pages.

Karmakar, N. C., "Investigations Into a Cavity-Backed Circular-Patch Antenna," IEEE Transactions on Antennas and Propagation, vol. 50, Dec. 1, 2002, pp. 1706-1715.

Payandehjoo et al., "Suppression of Substrate Coupling Between Slot Antennas Using Electromagnetic Bandgap Structures," Antennas and Propagation Society International Symposium, 2008, AP-S, 2008. IEEE, IEEE, Piscataway, NJ, USA, Jul. 5, 2008; pp. 1-4, XP31824233.

Ramirez et al., "Concentric Annular Ring Slot Antenna for Global Navigation Satellite Systems," IEEE Antennas and Wireless Propagation Letters, IEEE, Piscataway, NJ, US, vol. 11, Jan. 1, 2012, pp. 705-707, XP11489275.

Rayno et al., "Dual-Polarization Cylindrical Long-Slot Array (CLSA) Antenna Integrated With Compact Broadband Baluns and Slot Impedance Transformers" IEEE Antennas and Wireless Propagation Letters, vol. 12, 2013, 4 pages.

Ruvio, G. et al., "Radial EBG cell layout for GPS patch antennas," Electronic Letters, the Institution of Engineering and Technology, Jun. 18, 2009, vol. 45, No. 13, pp. 663-664.

Sun et al., "Design and Investigation of a Dual-Band Annular Ring Slot Antenna for Aircraft Applications," Progress in Electromagnetics Research C, vol. 38, Jan. 1, 2013, pp. 6778, XP055265587.

Tanabe, M. et al., "A Bent-Ends Spiral Antenna above a Fan-Shaped Electromagnetic Band-Gap Structure," 9th European Conference on Antennas and Propagation, EURAAP, Apr. 13, 2015, pp. 1-4.

International Application No. PCT/US2015/067621, International Search Report and Written Opinion dated Apr. 26, 2016, 14 pages.

International Search Report and Written Opinion for Application No. PCT/US2017/067276, dated Mar. 19, 2018, 20 pages.

International Search Report and Written Opinion for Application No. PCT/US2018/013876, dated Jun. 13, 2018, 15 pages.

U.S. Appl. No. 14/587,641 First Action Interview Pilot Program Pre-Interview Communication dated Aug. 12, 2016, 5 pages.

U.S. Appl. No. 14/587,641 First Action Interview Office Action Summary dated Oct. 3, 2016, 7 pages.

U.S. Appl. No. 14/587,641 Notice of Allowance dated Oct. 26, 2016, 9 pages.

U.S. Appl. No. 15/410,086 First Action Interview Pilot Program Pre-Interview Communication dated May 29, 2018, 5 pages.

U.S. Appl. No. 15/410,086 Notice of Allowance dated Sep. 6, 2018, 14 pages.

U.S. Appl. No. 15/394,309 Restriction Requirement dated Nov. 5, 2018, 7 pages.

U.S. Appl. No. 15/394,309 Non-Final Office Action dated Mar. 18, 2019, 23 pages.

U.S. Appl. No. 15/394,309 Final Office Action dated May 29, 2019, 22 pages.

U.S. Appl. No. 15/394,309 Notice of Allowance dated Aug. 7, 2019, 8 pages.

U.S. Appl. No. 16/182,852 Preinterview First Office Action dated Jan. 3, 2019, 4 pages.

U.S. Appl. No. 16/182,852 Notice of Allowance dated Mar. 28, 2019, 9 pages.

U.S. Appl. No. 16/681,618 Non-Final Office Action dated Apr. 15, 2020, 14 pages.

U.S. Appl. No. 16/681,618 Notice of Allowance dated Aug. 4, 2020, 12 pages.

* cited by examiner

ANTENNAS FOR RECEPTION OF SATELLITE SIGNALS

FIELD OF THE INVENTION

Embodiments described herein relate generally to slot antennas, and more particularly, to circularly polarized connected-slot antennas with improved reception of satellite signals.

BACKGROUND

Conventional slot antennas include a slot or aperture formed in a conductive plate or surface. The slot forms an opening to a cavity, and the shape and size of the slot and cavity, as well as the driving frequency, contribute to a radiation pattern. The length of the slot depends on the operating frequency and is typically about $\lambda/2$ and inherently narrowband. Conventional slot antennas are linearly polarized and can have an almost omnidirectional radiation pattern. More complex slot antennas may include multiple slots, multiple elements per slot, and increased slot length and/or width.

Slot antennas are commonly used in applications such as navigational radar and cell phone base stations. They are popular because of their simple design, small size, and low cost. Improved designs are constantly sought to improve performance of slot antennas, increase their operational bandwidth, and extend their use for other applications.

SUMMARY

Some embodiments described herein provide circularly polarized connected-slot antennas with improved reception of satellite signals. In an embodiment, for example, the slot is formed in a circular shape and includes one or more feed elements that can be phased to provide circular polarization. The slot is connected in the sense that it is formed by a dielectric extending between conductors. The connected-slot antennas described herein can be configured for specific frequencies, wider bandwidth, and improved reception of satellite signals at global navigation satellite system (GNSS) frequencies (e.g., approximately 1.1-2.5 GHz).

In accordance with an embodiment, an antenna configured to receive GNSS signals includes a substrate, a frontside patch arranged on a front side of the substrate, one or more impedance transformers, and a metamaterial ground plane. Each of the one or more impedance transformers include a microstrip arranged on the front side of the substrate, each microstrip coupled to an antenna feed at an input and coupled to the frontside patch at an output. The metamaterial ground plane includes a plurality of backside patches arranged on a backside of the substrate and separated from the frontside patch by the substrate. The plurality of backside patches include a center backside patch surrounded in a radial direction by a plurality of intermediate backside patches, and an outer backside patch surrounding the plurality of intermediate backside patches. The center backside patch and the plurality of intermediate backside patches are arranged in a pattern that provides circular symmetry with respect to a center of the antenna. The metamaterial ground plane also includes a cavity coupled to the substrate. Each of the plurality of intermediate backside patches are electrically isolated from the cavity.

In an embodiment, the outer backside patch has a ring-shape that extends around the plurality of intermediate backside patches, and the outer backside patch is not circular symmetric with respect to the center of the antenna.

In another embodiment, each of the plurality of intermediate backside patches that are disposed opposite an impedance transformer provide a ground pad for the impedance transformer, and others of the plurality of intermediate backside patches are electrically floating.

In another embodiment, the outer backside patch is coupled to an upper portion of the cavity.

In another embodiment, the outer backside patch extends radially to an outer edge of the substrate in some areas and is isolated from the outer edge of the substrate in other areas. Portions of the outer backside patch that extend to the outer edge of the substrate are directly coupled to the cavity and portions of the outer backside patch that are isolated from the outer edge of the substrate are not directly coupled to the cavity.

In another embodiment, an outer edge of the substrate includes outward protruding portions and recessed portions, the plurality of intermediate backside patches are each isolated from adjacent ones of the plurality of intermediate backside patches by a space, and the outer backside patch extends radially outward to an outer edge of the outward protruding portions of the substrate and extends radially inward from an outer edge of the recessed portions of the substrate. Each portion of the outer backside patch that extends to the outer edge of one of the outward protruding portions is positioned radially outward from one of the spaces between the adjacent ones of the plurality of intermediate backside patches.

In another embodiment, the frontside patch is electrically coupled to the cavity by a connector.

In another embodiment, a portion of the plurality of intermediate backside patches are each coupled to a ground of the antenna feed.

In another embodiment, the substrate includes outward protruding portions and recessed portions. The plurality of intermediate backside patches are each isolated from adjacent ones of the plurality of intermediate backside patches by a space, and the outward protruding portions of the substrate are positioned radially outward from one of the spaces between adjacent ones of the plurality of intermediate backside patches.

In yet another embodiment, the frontside patch includes one or more elongated sections extending radially outward from the frontside patch. Each of the one or more elongated sections is coupled to the output of a corresponding microstrip, and each microstrip is disposed radially outward beyond an end of an associated one of the one or more elongated sections.

In accordance with another embodiment, an antenna configured to receive GNSS signals includes a substrate, a frontside patch arranged on a front side of the substrate, one or more antenna feeds electrically coupled to the frontside patch, and a metamaterial ground plane. The metamaterial ground plane includes a plurality of backside patches arranged on a backside of the substrate and separated from the frontside patch by the substrate. The plurality of backside patches include a center backside patch surrounded in a radial direction by a plurality of intermediate backside patches. The center backside patch and the plurality of intermediate backside patches are arranged in a pattern that provides circular symmetry with respect to a center of the antenna. A diameter of the center backside patch is different from a radial width of each of the plurality of intermediate backside patches. The metamaterial ground plane also includes a cavity coupled to the substrate.

In an embodiment, each of the plurality of intermediate backside patches are electrically isolated from the cavity.

In another embodiment, the plurality of intermediate backside patches are surrounded by an outer backside patch having a ring-shape that extends around the plurality of intermediate backside patches. The outer backside patch is not circular symmetric with respect to the center of the antenna.

In another embodiment, the plurality of intermediate backside patches are surrounded in a radial direction by an outer backside patch, and the outer backside patch is electrically coupled to the cavity.

In another embodiment, the plurality of intermediate backside patches are each isolated from adjacent ones of the plurality of intermediate backside patches by a space.

In yet another embodiment, an outer edge of the substrate includes outward protruding portions and recessed portions, the plurality of intermediate backside patches are each isolated from adjacent ones of the plurality of intermediate backside patches by a space, and an outer backside patch surrounds the plurality of intermediate backside patches and extends radially outward to an outer edge of the outward protruding portions of the substrate and extends radially inward from an outer edge of the recessed portions of the substrate. Each portion of the outer backside patch that extends to the outer edge of one of the outward protruding portions is positioned radially outward from one of the spaces between the adjacent ones of the plurality of intermediate backside patches.

In accordance with yet another embodiment, an antenna configured to receive GNSS signals includes a substrate, a frontside patch arranged on a front side of the substrate, one or more impedance transformers arranged on a front side of the substrate, and a metamaterial ground plane. Each of the one or more impedance transformers is coupled to an input feed and coupled to the frontside patch at an output. The metamaterial ground plane includes a plurality of backside patches arranged on a backside of the substrate and separated from the frontside patch by the substrate. The plurality of backside patches including a center backside patch surrounded in a radial direction by a plurality of intermediate backside patches, and an outer backside patch surrounding the plurality of intermediate backside patches. The center backside patch is separated from each of the plurality of intermediate backside patches by a first space, and each of the intermediate backside patches are separated from adjacent ones of the intermediate backside patches by a second space. The first space between the center backside patch and each of the plurality of intermediate backside patches is greater than the second space between adjacent ones of the plurality of intermediate backside patches. The metamaterial ground plane also includes a cavity coupled to the substrate.

In an embodiment, an outer edge of the substrate includes outward protruding portions and recessed portions. The outer backside patch extends radially outward to an outer edge of the outward protruding portions of the substrate and extends radially inward from an outer edge of the recessed portions of the substrate. Portions of the outer backside patch that extend radially inward from the outer edge of the recessed portions are each separated from an adjacent one of the plurality of intermediate backside patches by a third space that is greater than the first space.

In another embodiment, an outer edge of the substrate includes outward protruding portions and recessed portions. The outer backside patch extends radially outward to an outer edge of the outward protruding portions of the substrate and extends radially inward from an outer edge of the recessed portions of the substrate. Portions of the outer backside patch that extend radially inward from the outer edge of the recessed portions are separated from one another by a fourth space that is greater than the second space.

In yet another embodiment, an outer edge of the substrate includes outward protruding portions and recessed portions. The outer backside patch extends radially outward to an outer edge of the outward protruding portions of the substrate and extends radially inward from an outer edge of the recessed portions of the substrate. Portions of the outer backside patch that extend radially outward to the outer edge of the outward protruding portions and portions of the outer backside patch that extend radially inward from the outer edge of the recessed portions are coupled directly to the cavity.

Numerous benefits are achieved using embodiments described herein over conventional antennas. For example, some embodiments provide a connected-slot antenna that has a reduced size and weight compared to conventional connected-slot antennas of comparable performance. The reduction in size and weight can also reduce manufacturing costs. Some embodiments described herein achieve these improvements by introducing additional design parameters to a metamaterial ground plane. Depending on the embodiment, one or more of these features and/or benefits may exist. These and other features and benefits are described throughout the specification with reference to the appended drawings.

DETAILED DESCRIPTION

Reference will now be made in detail to the various embodiments, one or more examples of which are illustrated in the figures. Within the following detailed description, the same reference numbers refer to same or similar components. The differences with respect to individual embodiments are described. Each example is provided by way of explanation and is not meant as a limitation. Further, features illustrated or described as part of one embodiment can be used on or in conjunction with other embodiments to yield yet a further embodiment. The description is intended to include these modifications and variations.

Some embodiments described herein provide circularly polarized connected-slot antennas. In some embodiments, for example, the connected-slot antennas include a metamaterial ground plane that includes backside patches and a cavity.

Figure 1:
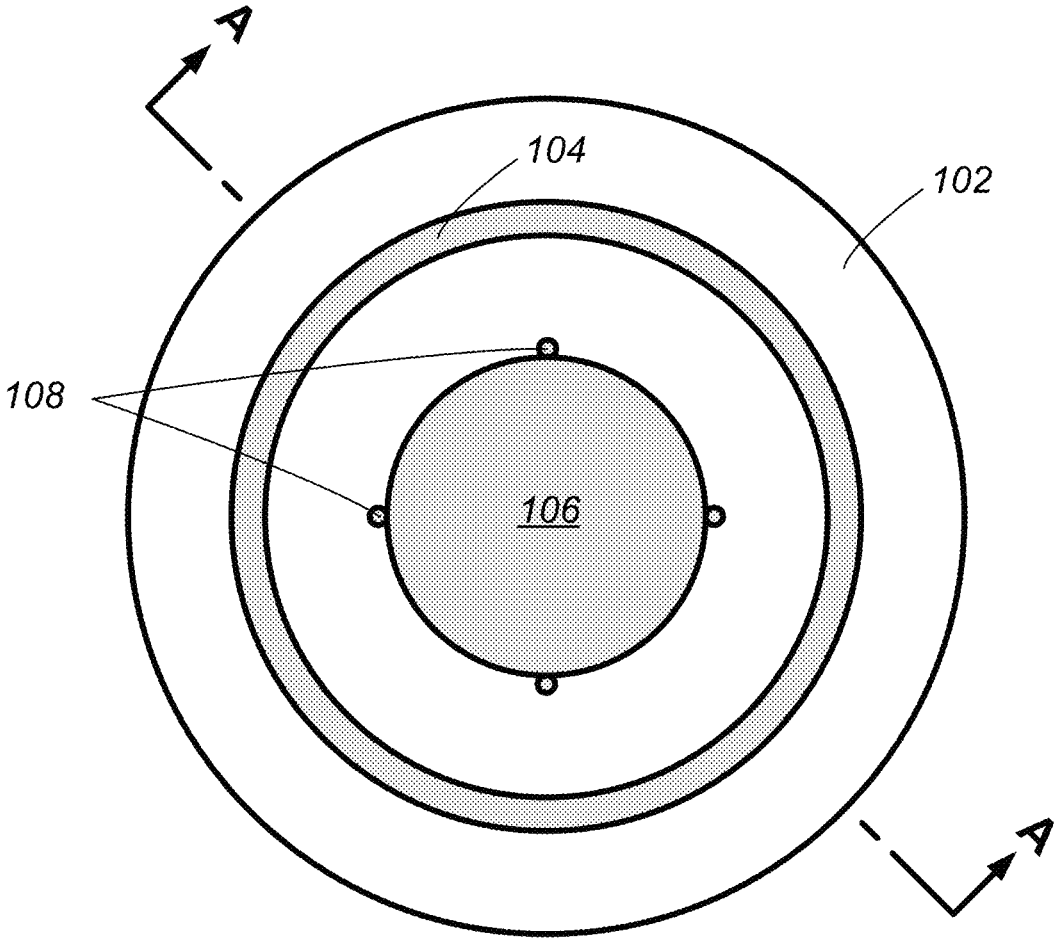
FIG. 1 is a simplified top view of a connected-slot antenna in accordance with an embodiment.

FIG. 1 is a simplified top view of a connected-slot antenna in accordance with an embodiment. A frontside patch 106 overlies a substrate 102. A ring 104 also overlies the substrate 102 and surrounds the frontside patch 106. The portion of the substrate 102 that extends between the frontside patch 106 and the ring 104 forms a slot. The slot provides electrical isolation between the frontside patch 106 and ring 104, both of which are electrically conducting. The frontside patch 106 may extend continuously as shown in this example or it may be in the shape of a ring that exposes the substrate 102 in a center region.

The substrate 102 may comprise a non-conductive dielectric material such as a plastic or ceramic. The frontside patch 106 and the ring 104 may comprise a conductive material such as a metal or alloy. In some embodiments, the dielectric material may include a non-conductive laminate or pre-preg, such as those commonly used for printed circuit board (PCB) substrates, and the frontside patch 106 and the ring 104 may be etched from a metal foil in accordance with known PCB processing techniques.

In some embodiments, the frontside patch 106 and the ring 104 each have a substantially circular shape, and diameters of the frontside patch 106 and the ring 104, as well as a distance between the frontside patch 106 and the ring 104, may be determined based on a desired radiation pattern and operating frequency. In an embodiment, the substrate 102 is substantially the same shape as the ring 104 and has a diameter that is greater than an outside diameter of the ring 104. The frontside patch 106 and/or substrate 102 may be substantially planar in some embodiments or have a slight curvature in other embodiments. The slight curvature can improve low elevation angle sensitivity.

The connected-slot antenna in this example also includes four feeds 108 that are disposed in the connected slot and coupled to the frontside patch 106. Other embodiments may include a different number of feeds (more or less). The feeds 108 provide an electrical connection between the frontside patch 106 and a transmitter and/or receiver. The feeds 108 are disposed around a circumference of the frontside patch 106 so that each feed 108 is spaced from adjacent feeds 108 by approximately equal angular intervals. The example shown in FIG. 1 includes four feeds 108, and each of the feeds 108 are spaced from adjacent feeds 108 by approximately 90°. For a connected-slot antenna with six feeds, the angular spacing would be approximately 60°; for a connected-slot antenna with eight feeds, the angular spacing would be approximately 45°; and so on.

The placement of the feeds 108 around the frontside patch 106 allows the feeds 108 to be phased to provide circular polarization. For example, signals associated with the four feeds 108 shown in FIG. 1 may each have a phase that differs from the phase of an adjacent feed by +90° and that differs from the phase of another adjacent feed by −90°. In an embodiment, the feeds are phased in accordance with known techniques to provide right hand circular polarization (RHCP). The number of feeds may be determined based on a desired bandwidth of the connected-slot antenna.

Figure 2:
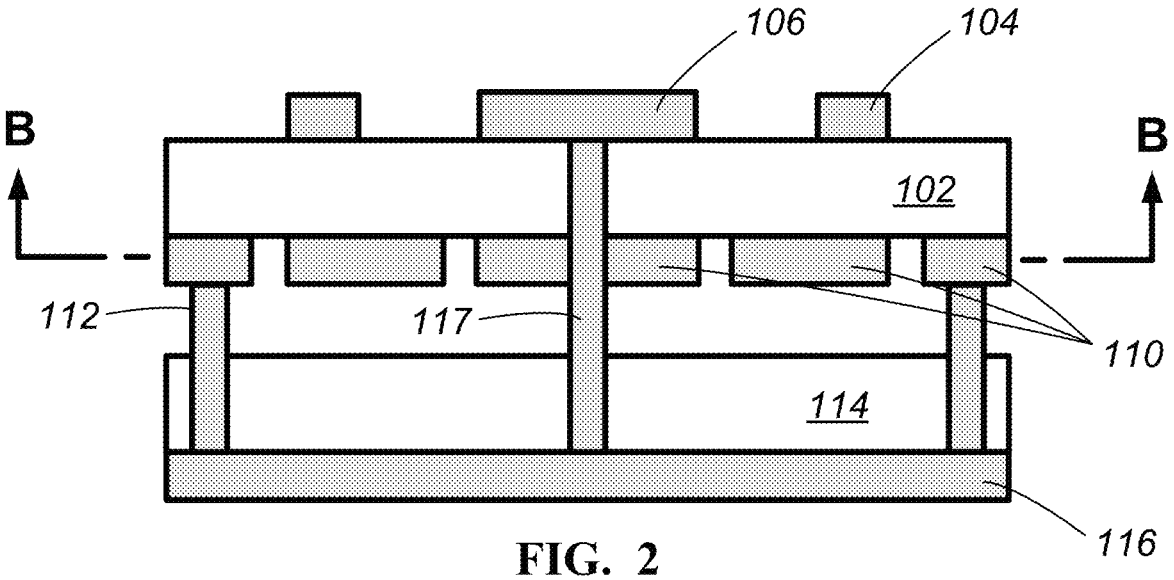
FIG. 2 is a simplified cross section along line A-A of the connected-slot antenna shown in FIG. 1 in accordance with an embodiment.

FIG. 2 is a simplified cross section along line A-A of the connected-slot antenna shown in FIG. 1 in accordance with an embodiment. This figure provides a cross-sectional view of the frontside patch 106, the ring 104, and the substrate 102. This figure shows a space separating the frontside patch 106 from the ring 104. The space may include air or another dielectric that provides electrical isolation between the frontside patch 106 and the ring 104.

This cross section also shows that the connected-slot antenna in this example includes patches 110 disposed on a backside of the substrate 102. The backside patches 110 are arranged along a first plane below the frontside patch 106 and are separated from the frontside patch 106 by the substrate 102. The backside patches 110 may be separated from adjacent backside patches 110 by a dielectric (e.g., air or another dielectric).

In some embodiments, the backside patches 110 may be separated from the frontside patch 106 and the ring 104 by one or more additional dielectrics as well. As an example, the backside patches 110 may be disposed on a top surface of dielectric 114 so that they are separated from the frontside patch 106 and the ring 104 by the substrate 102 plus another dielectric (e.g., air or another dielectric filling the space between the substrate 102 and the dielectric 114). In yet other embodiments, the backside patches 110 may be coupled to a backside of the substrate 102 and to a front side of the dielectric 114 (eliminating the space).

FIG. 2 also shows a ground plane 116 that is electrically grounded and coupled to a first portion of the backside patches 110 by first vias 112 and electrically isolated from a second portion of the backside patches 110. In this example, the ground plane 116 is also coupled to one of the backside patches 110 and to the frontside patch 106 by a second via 117. As shown in FIG. 1, the frontside patch 106 is coupled to the feeds 108 along a perimeter of the frontside patch 106 to provide an active (radiating) element. A center of the frontside patch 106 may be coupled to ground by the second via 117.

The backside patches 110, the first vias 112, the second via 117, and the ground plane 116 are part of a metamaterial ground plane. The metamaterial ground plane can provide an artificial magnetic conductor (AMC) with electromagnetic band-gap (EBG) behavior. This allows the metamaterial ground plane to be disposed at a distance of less than $\lambda/4$ from the frontside patch 106 and the ring 104 while still providing a constructive addition of the direct and reflected waves over the desired frequencies (e.g., approximately 1.1-2.5 GHz). In some embodiments, the metamaterial ground plane also provides surface wave suppression and reduces left hand circular polarized (LHCP) signal reception to improve the multipath performance over a wide bandwidth. With the metamaterial ground plane, antenna gain can be on the order of 7-8 dBi in some embodiments, with strong radiation in the upper hemisphere, including low elevation angles, and negligible radiation in the lower hemisphere for enhanced multipath resilience.

The backside patches 110, the first vias 112, the second via 117, and the ground plane 116 may each comprise a conductive material such as a metal or alloy. In an embodiment, the backside patches 110 and the ground plane 116 may be etched from a metal foil in accordance with known PCB processing techniques. The first vias 112 and the second via 117 may comprise a metal pin (solid or hollow) or may be formed using a via etch process that forms via holes through the dielectrics and then deposits a conductive material in the via holes. Alternatively, at least one of the first vias 112 or the second via 117 may comprise a fastener or connector such as a nut and bolt or rivet.

The dielectric 114 may comprise an electrically non-conductive material such as air, plastic, or a ceramic. In some embodiments, the dielectric 114 may include a non-conductive laminate or pre-preg, such as those commonly used for PCB substrates.

In some embodiments, the second via 117 may extend only from the ground plane 116 to one of the backside patches 110 in a manner similar to the first vias 112 in this example (rather than also extending through the substrate 102 to the frontside patch 106). In these embodiments, the frontside patch 106 may not be coupled to ground. Connection between the frontside patch and ground may not be necessary in some embodiments.

These different configurations are provided merely as examples, and each of the simplified cross sections may include (i) a center via that extends through the substrate and is coupled to the frontside patch, (ii) a center via that extends only from the ground plane to one of the backside patches, or (iii) no center via. In some embodiments, the vias include fasteners or spacers that provide structural support, and the particular configuration of the vias is determined at least in part based on desired structural features.

Also, in some embodiments, each of the backside patches 110 may be coupled to the ground plane 116 using additional vias (instead of only some of the backside patches 110 being coupled to the ground plane 116 as shown in the example of FIG. 2). Further, in some embodiments, the first vias 112 may extend through the substrate 102 like the second via 117. In these embodiments, the first vias 112 may be coupled to the ring 104 or isolated from the ring 104. Other embodiments may not include a ring or they may include a discontinuous ring (described below).

FIGS. 3-7 are simplified bottom views along line B-B of the connected-slot antenna shown in FIG. 2 in accordance some embodiments.

Figure 3:
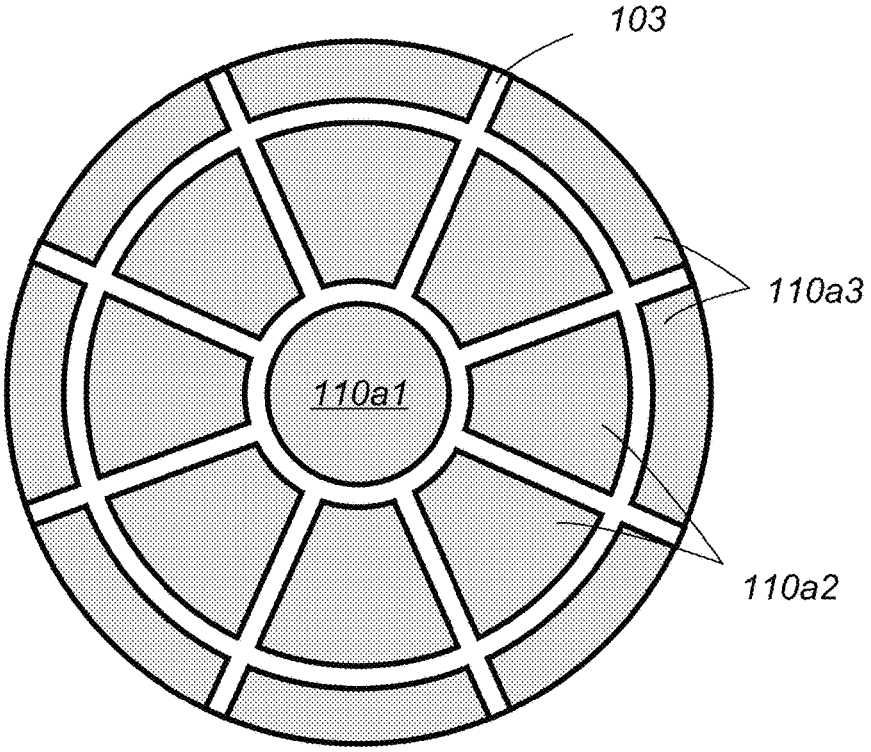
FIGS. 3-4 are simplified bottom views along line B-B of the connected-slot antenna shown in FIG. 2 in accordance with some embodiments.

FIG. 3 shows an arrangement that includes a center backside patch **110*a*1, intermediate backside patches 110*a*2, and outer backside patches 110*a*3. The backside patches 110*a*1, 110*a*2, 110*a*3 are separated by spaces 103. The spaces 103** may include air or another dielectric.

The center backside patch **110*a*1 is surrounded in a radial direction by the intermediate backside patches 110*a*2, and the intermediate backside patches 110*a*2 are surrounded in a radial direction by the outer backside patches 110*a*3. These backside patches 110*a*1, 110*a*2, 110*a*3 can be aligned with the feeds (e.g., feeds 108 in FIG. 1) so that one of the intermediate backside patches 110*a*2 is on an opposite side of the substrate 102** from each feed.

This arrangement provides backside patches arranged in a pattern that provides circular symmetry with respect to a center (or phase center) of the antenna. The backside patches **110*a*1, 110*a*2, 110*a*3 provide circular symmetry by having equal distances between a center of the backside patch 110*a*1 and any point along curved inner edges of the intermediate backside patches 110*a*2, between the center and any point along curved outer edges of the intermediate backside patches 110*a*2, between the center and any point along curved inner edges of the outer backside patches 110*a*3, and between the center and any point along curved outer edges of the outer backside patches 110*a*3. Thus, all paths are the same that pass radially outward from the center of the center backside patch 110*a*1 and through the intermediate and outer backside patches 110*a*2, 110*a*3**. The circular symmetry can reduce variation in gain and improve phase center stability, particularly for low angle signals.

Figure 4:
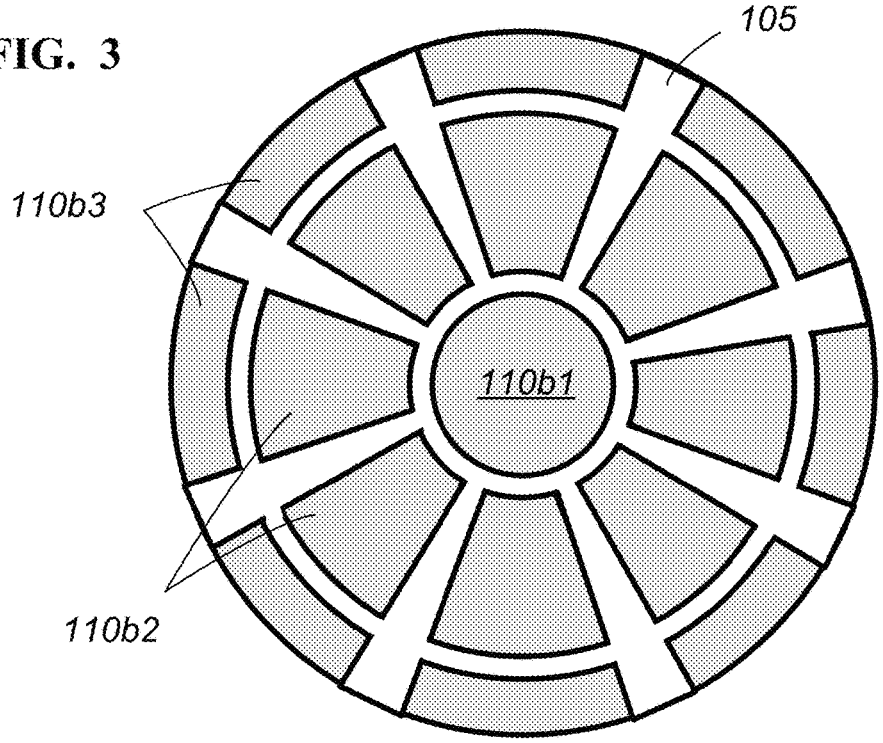

FIG. 4 is similar to FIG. 3 except a width of the radial spacing 105 between adjacent intermediate backside patches **110*b*2 and outer backside patches 110*b*3 increases with distance from the center backside patch 110*b*1. Similarly, radial spacing between the intermediate backside patches 110*b*2 and the center backside patch 110*b*1 may be different than the radial spacing between the outer backside patches 110*b*3 and the intermediate backside patches 110*b*2**.

Any number of intermediate backside patches and outer backside patches can be used. The number may be based on a number of feeds in some embodiments. For example, there may be a corresponding intermediate backside patch for each feed. The number of intermediate backside patches may be equal to the number of feeds in some embodiments. In other embodiments, the number of intermediate backside patches may be greater than the number of feeds. For example, the embodiments shown in FIGS. 3-4 include eight intermediate backside patches and may be used with antennas that have eight feeds in some embodiments, four feeds in other embodiments, and two feeds in yet other embodiments.

Figure 5:
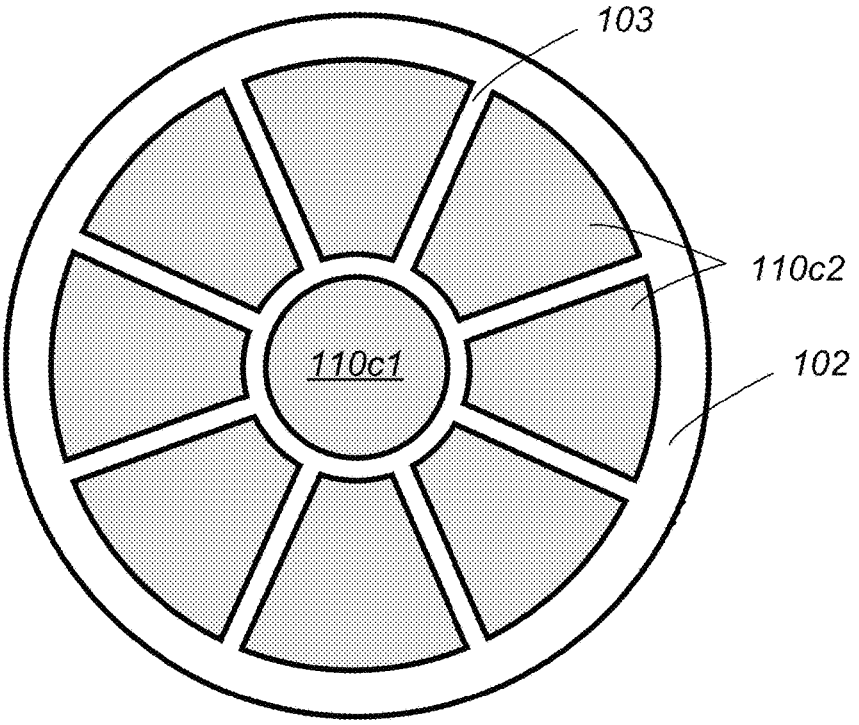
FIGS. 5-7 are simplified bottom views of backside patch arrangements for connected-slot antennas in accordance with some embodiments.
Figure 6:
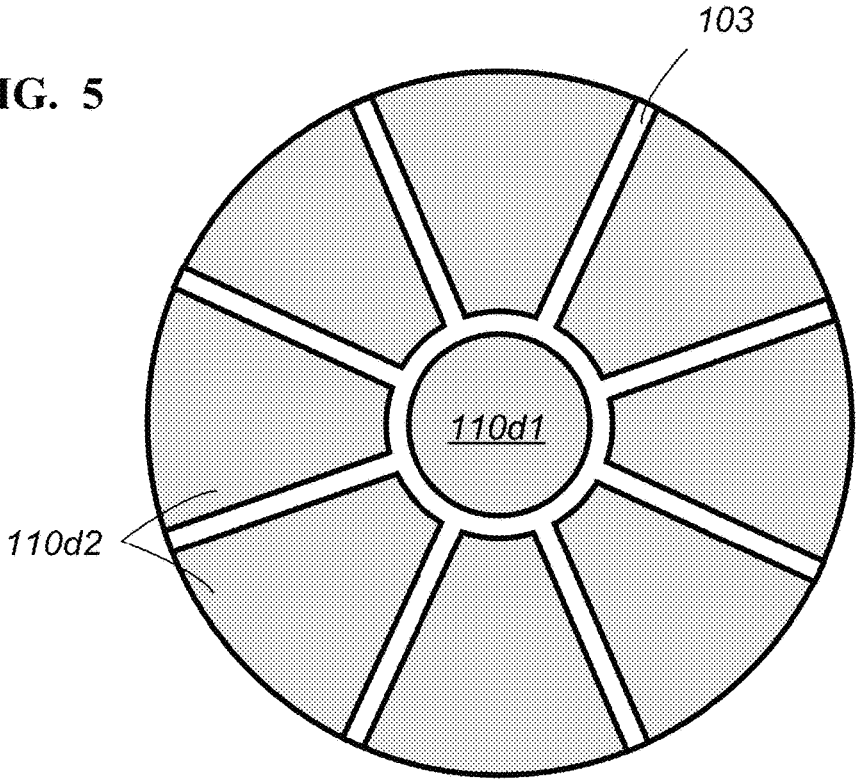
Figure 7:
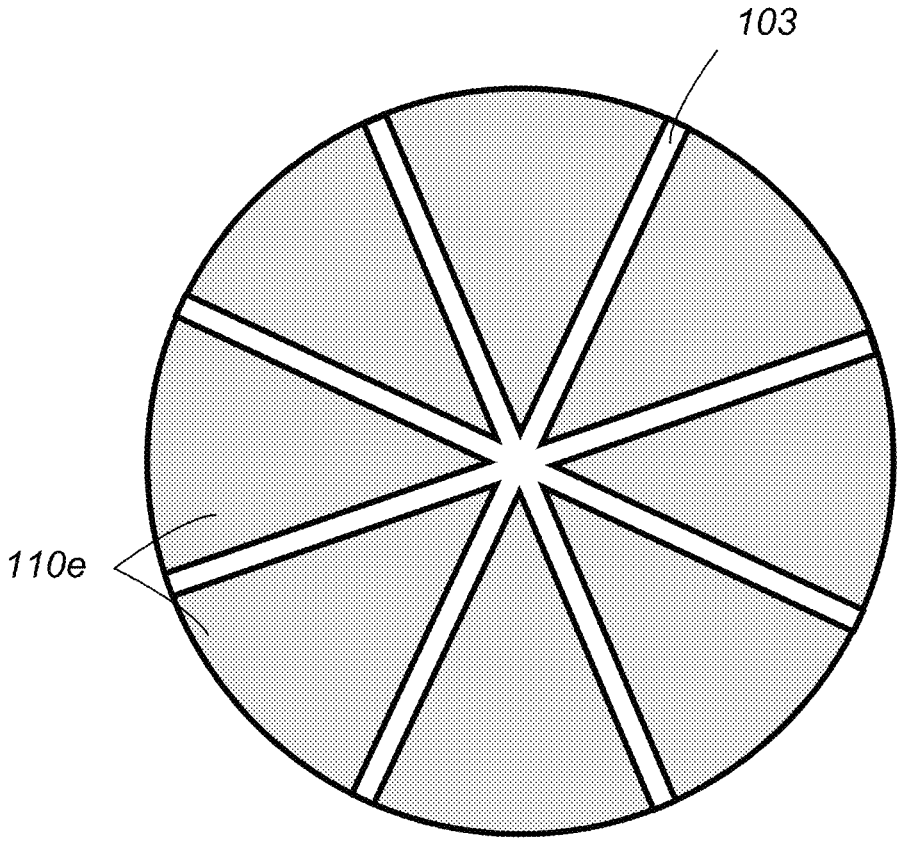

FIGS. 5-7 are simplified bottom views of backside patch arrangements for connected-slot antennas in accordance with other embodiments. FIG. 5 shows an arrangement that includes a center backside patch 110*c*1 and surrounding backside patches 110*c*2. This arrangement is similar to that shown in FIGS. 3-4 in that it provides circular symmetry with respect to a center (or phase center) of the antenna. This arrangement is different from that shown in FIGS. 3-4 in that it does not include outer backside patches. The center backside patch 110*c*1 is surrounded in a radial direction by the surrounding backside patches 110*c*2.

In some embodiments that include a fence (described below), the outer backside patches shown in FIGS. 3-4 may be electrically coupled to the fence to provide a short to ground. In FIG. 5, the surrounding backside patches 110*c*2 do not extend to an edge of the substrate 102 and thus in some embodiments are not electrically coupled to the fence along an edge of the substrate 102.

FIG. 6 shows an arrangement that includes a center backside patch 110*d*1 and surrounding backside patches 110*d*2. In this example, the surrounding backside patches 110*d*2 extend to an edge of the substrate 102 and, if a fence is included, the surrounding backside patches 110*d*2 may be electrically coupled to the fence in some embodiments.

FIG. 7 is similar to FIG. 6, but it does not include a center backside patch. FIG. 7 only includes backside patches 110*e* that extend from near a center of the substrate 102 to an edge of the substrate 102. In other embodiments, the backside patches 110*e* may not extend to the edge in a manner similar to FIG. 5. Each of the examples shown in FIGS. 5-7 are similar to the examples shown in FIGS. 3-4 in that they provide circular symmetry with respect to a center (or phase center) of the antenna. In addition to providing circular symmetry, these examples allow similar alignment between the backside patches and feeds (or between the backside patches and the ground pads associated with the microstrips as described below).

FIGS. 3-7 are provided merely as examples, and the backside patches 110 are not limited to these particular shapes. Each of the backside patches 110 may have a different shape and, in some embodiments, the backside patches may include, or function as, a ground pad for a microstrip (described below). Using the description provided herein, the particular shape and arrangement of the backside patches 110 may be determined in accordance with known techniques based on desired operating characteristics. The backside patches 110 shown in these examples may be used with any of the connected-slot antennas described herein.

Figure 8A:
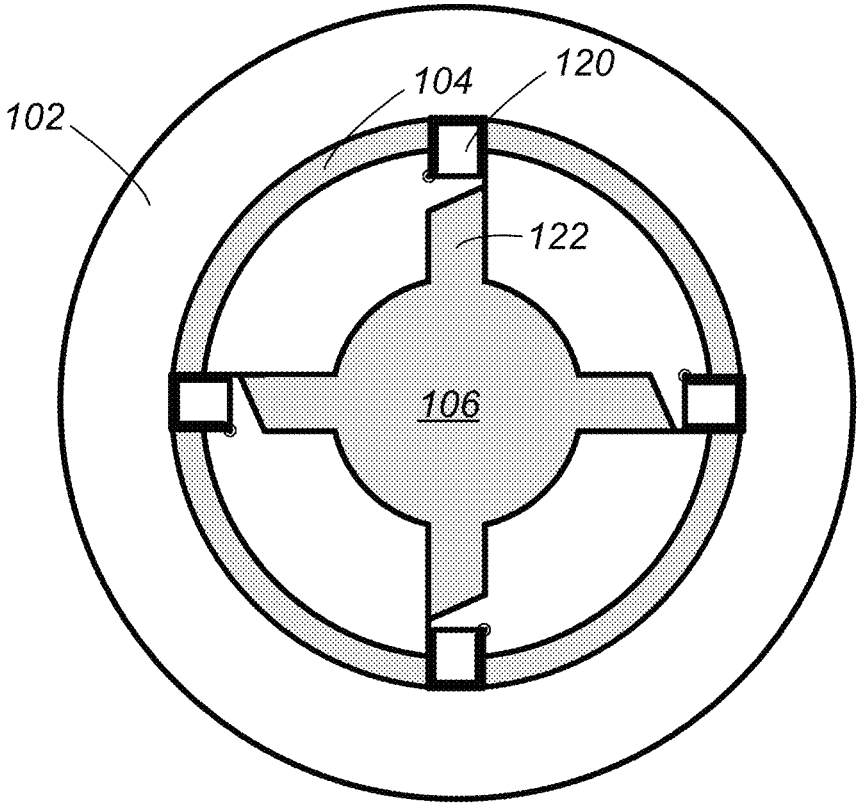
FIG. 8*a* is a simplified top view of a connected-slot antenna in accordance with another embodiment.

FIG. 8*a* is a simplified top view of a connected-slot antenna in accordance with another embodiment. This embodiment is similar to the example shown in FIG. 1 in that it includes a frontside patch 106 and a ring 104 overlaying a substrate 102. This embodiment is different from the example shown in FIG. 1 in that the antenna feeds include impedance transformers 120. The impedance transformers 120 perform load matching between an input and the antenna structure. In an embodiment, for example, a typical impedance at an input of a transmission line (e.g., a coaxial cable) may be approximately 50 Ω, and an impedance of the antenna may be higher (e.g., approximately 100 Ω, 200 Ω, or more). Each impedance transformer 120 can be configured to convert the impedance of the input to the impedance of the antenna.

In the example shown in FIG. 8*a*, the frontside patch 106 also includes elongated sections 122 extending radially outward from a circular portion of the frontside patch 106. The elongated sections may not be used in some embodiments. Each elongated section 122 is spaced from adjacent elongated sections 122 by approximately equal angular intervals. Each elongated section 122 is positioned adjacent to an output of one of the impedance transformers 120. The elongated sections 122 provide a connection between the output of the impedance transformers 120 and the frontside patch 106. The elongated sections 122 shown in FIG. 8*a* are provided merely as examples, and other embodiments that include elongated sections may use different sizes and shapes of elongated sections. The elongated sections 122 may comprise a conductive material such as a metal or alloy. In an embodiment, the elongated sections 122 may be etched from a metal foil in accordance with known PCB processing techniques.

Figure 8B:
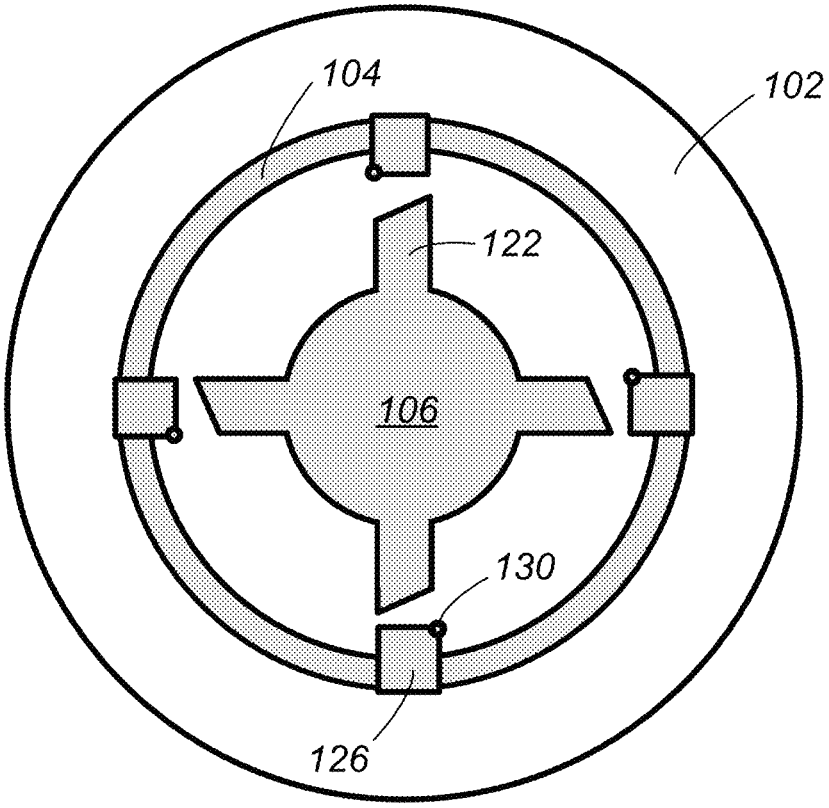
FIGS. 8*b*-8c are simplified top views of portions of the connected-slot antenna shown in FIG. 8*a* in accordance with some embodiments.

In an embodiment, the impedance transformers 120 each include a microstrip and ground pad that are separated by a dielectric. These features can be illustrated with reference to FIGS. 8*b*-8*c*, which are simplified top views of portions of the connected-slot antenna shown in FIG. 8*a* in accordance with some embodiments. In FIG. 8*b*, the microstrip and dielectric of the impedance transformers 120 are removed to expose ground pads 126. The ground pads 126 are electrically coupled to the ring 104. Each ground pad 126 may include a small ring 130 for connection to ground. If a coaxial cable is used as a transmission line, a ground (or shield) may be coupled to the ground pad 126 at the small ring 130. This is shown and explained further with regard to FIG. 9.

Figure 8C:
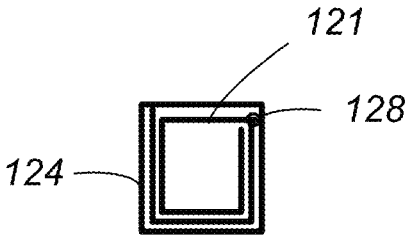

FIG. 8*c* shows a microstrip 121 on a dielectric 124. The microstrip 121 and dielectric 124 are configured to overlay each of the ground pads 126. Each microstrip 121 and ground pad 126 are conductive, and the dielectric 124 provides electrical isolation between the microstrip 121 and ground pad 126. Each microstrip 121 includes an input 128 for connection to a feed. If a coaxial cable is used as a transmission line, a core may be coupled to the input 128. Each microstrip 121 includes at least two traces. This is shown and explained further below with regard to FIGS. 10-14.

The ground pads 126 and microstrips 121 may comprise a conductive material such as a metal or alloy. In an embodiment, the ground pads 126 and microstrips 121 may be etched from a metal foil in accordance with known PCB processing techniques.

The frontside patch 106, ring 104, and substrate 102 may be arranged in a manner similar to that described above with regard to FIG. 1. This embodiment may also include any of the other features described above with regard to FIG. 2 and described below with regard to any of the other figures.

Figure 9:
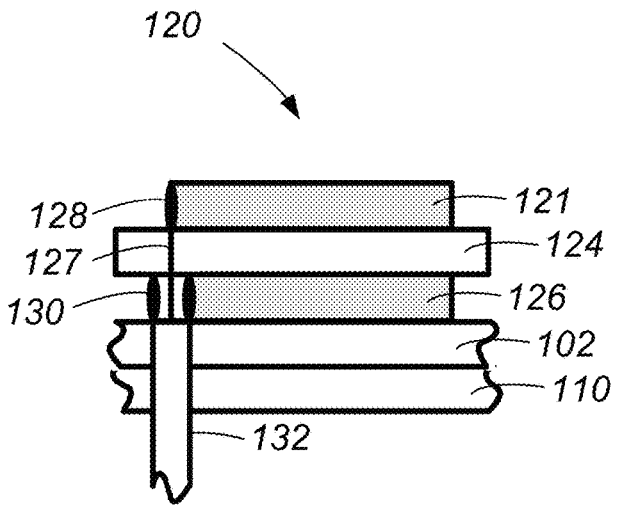
FIGS. 9-15 are simplified diagrams of impedance transformers, or portions of impedance transformers, in accordance with some embodiments.

FIG. 9 is a simplified cross section of an impedance transformer in accordance with an embodiment. A dielectric 124 (dielectric plate) separates the microstrip 121 from the ground pad 126. A transmission line 132 (e.g., a coaxial cable) extends through the substrate 102. The transmission line 132 includes a ground (or shield) that is coupled to the ground pad 126 at the small ring 130 and a core 127 that extends through the dielectric 124 and is coupled to the microstrip 121 at the input 128 to provide an antenna feed.

Figure 10:
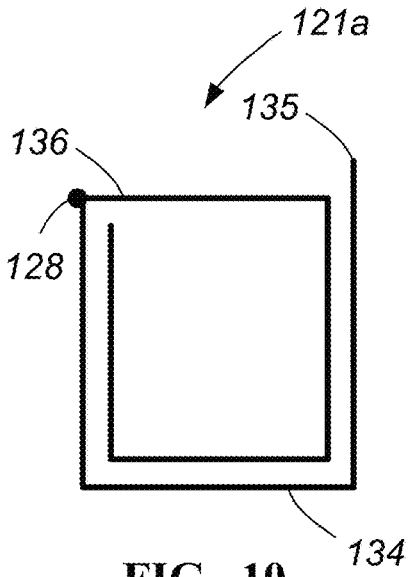
Figure 11:
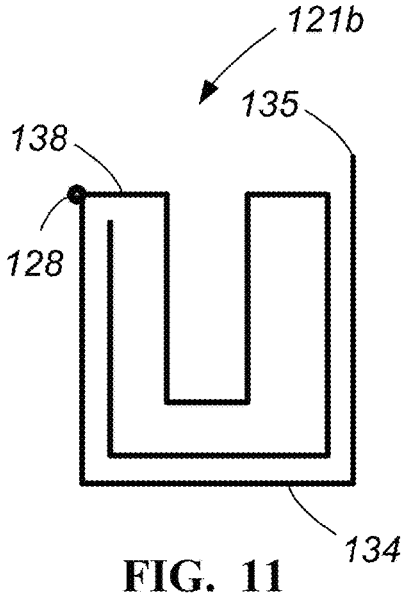
Figure 12:
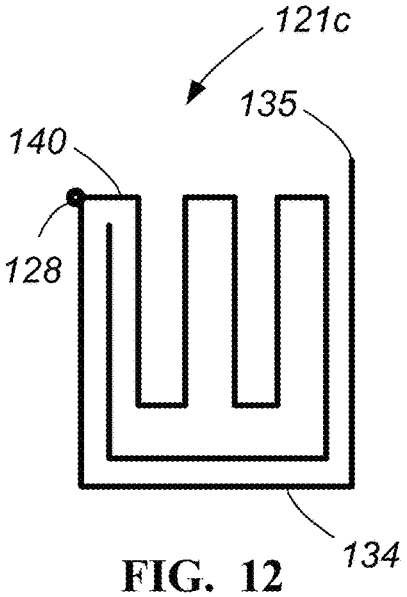

FIG. 10 is a simplified top view of a microstrip 121*a* in accordance with an embodiment. The microstrip 121*a* includes two traces 134, 136. The first trace 134 has one end coupled to an input 128 and another end coupled to an output 135. The input 128 is coupled to a feed (e.g., from a transmission line), and the output 135 is coupled to a patch (e.g., frontside patch 106). The second trace 136 has one end coupled to the input 128 and another end that is free from connection with a conductor. The first and second traces 134, 136 may extend substantially parallel to but separate from each other along multiple sections of the microstrip 121*a*. In this example, each section also extends substantially perpendicular to an adjacent section.

Figure 13:
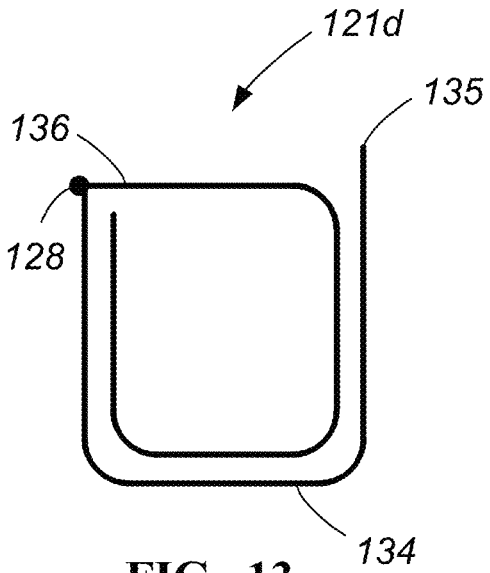
Figure 14:
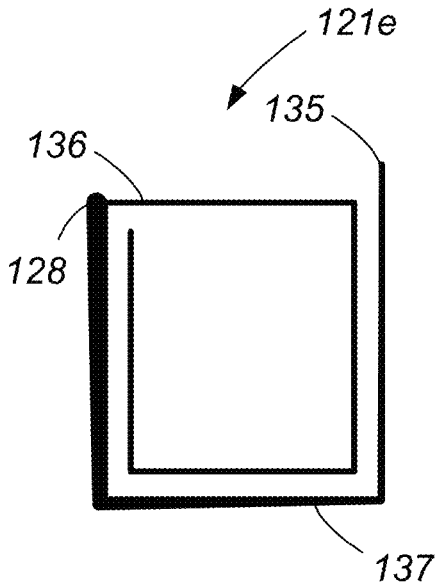

FIGS. 11-14 are simplified top views of microstrips in accordance with other embodiments. In the example shown in FIG. 11, a second trace 138 of microstrip 121*b* is longer than the example shown in FIG. 10. The second trace 138 has additional sections that extend parallel to other sections. In the example shown in FIG. 12, a second trace 140 of microstrip 121*c* is longer than the example shown in FIG. 11. The second trace 140 has even more sections that extend parallel to other sections. FIG. 13 is a simplified top view of a microstrip 121*d* in accordance with another embodiment. This example is similar to that of FIG. 10 but with rounded corners instead of sharper corners. FIG. 14 is a simplified top view of a microstrip 121*e* in accordance with another embodiment. This example is similar to that of FIG. 10 but a width of a first trace 137 at the input 128 is greater than the width at the output 135. Although not shown in this example, a width of the second trace 136 may also decrease with distance from the input 128. In some embodiments, the decreasing width of the traces, or the increasing space between the traces, can increase impedance of the microstrip leading to increased bandwidth of the antenna. This can reduce loss and increase gain.

The different shapes of the traces in FIGS. 10-14 are provided merely as examples, and the microstrips are not intended to be limited to these examples. A length of the two traces, spacing between the traces, and shape of the traces may be determined based on desired matching characteristics.

Figure 15:
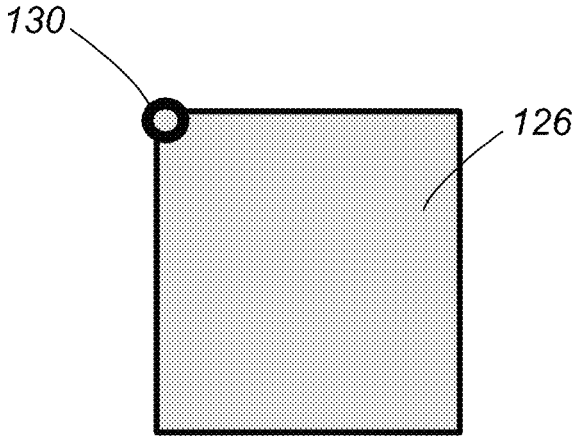

FIG. 15 is a simplified top view of a ground pad 126 in accordance with an embodiment. The ground pad 126 serves as a ground plane for the impedance transformer. This figure shows the small ring 130 for forming an electrical connection with ground. In an embodiment, the ground pad 126 is the same size or slightly larger than the main sections of the associated microstrip 121 and is arranged under the associated microstrip 121. The output 135 of an associated microstrip may extend beyond an edge of the ground pad 126.

Figure 16A:
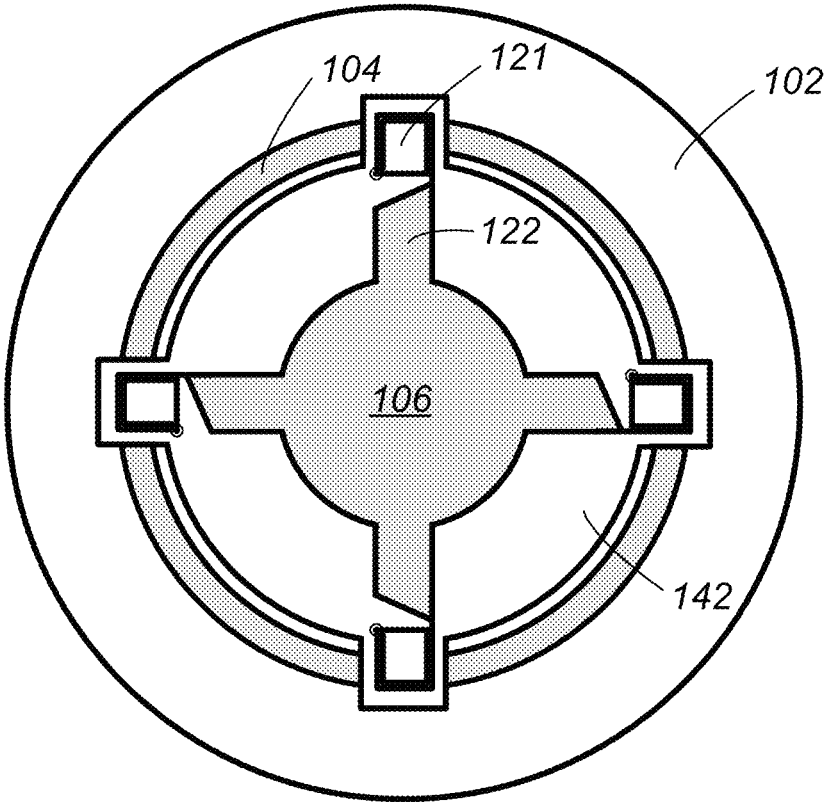
FIG. 16*a* is a simplified top view of a connected-slot antenna in accordance with another embodiment.
Figure 16B:
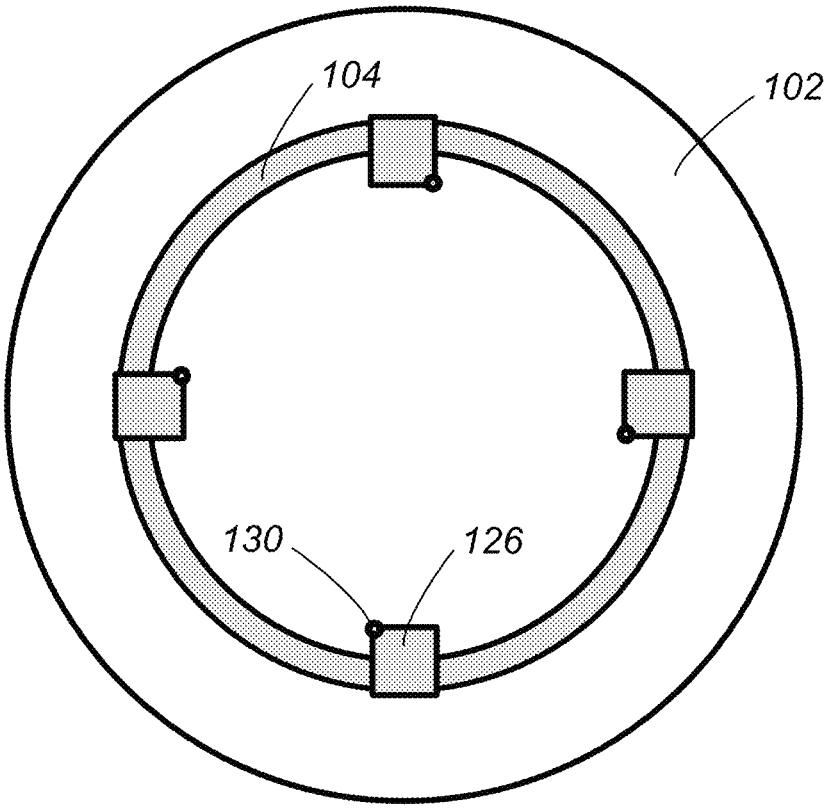
FIGS. 16*b*-16*c* are simplified top views of portions of the connected-slot antenna shown in FIG. 16*a* in accordance with some embodiments.
Figure 16C:
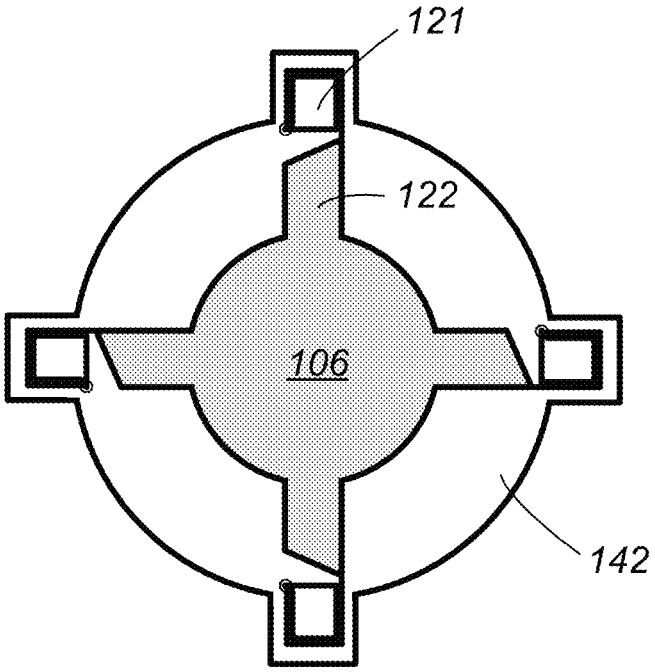

FIG. 16*a* is a simplified top view of a connected-slot antenna in accordance with another embodiment. This embodiment is similar to the embodiment shown in FIG. 8*a*, but a frontside patch 106, elongated sections 122, and microstrips 121 overlay a disc 142, and a ring 104 and ground pads 126 overlay a substrate 102. This is shown more clearly in FIGS. 16*b*-16*c*. FIG. 16*b* shows the ring 104 and ground pads 126 overlaying the substrate 102, and FIG. 16*c* shows the frontside patch 106, elongated sections 122, and microstrips 121 overlaying the disc 142. In this example, the backside patches and ground plane (not shown) are separated from the frontside patch 106 by at least the substrate 102 and the disc 142. The disc 142 may be a dielectric material that provides electrical isolation between the frontside patch 106, elongated sections 122, and microstrips 121 on a frontside of the disc 142, and the ring 104 and ground pads 126 on a frontside of the substrate 102.

Figure 17:
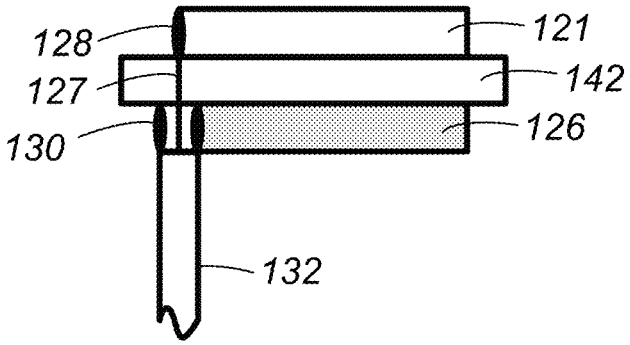
FIG. 17 is a simplified cross section of an impedance transformer in accordance with an embodiment.

FIG. 17 is a simplified cross section of an impedance transformer in accordance with another embodiment. This figure is similar to FIG. 9, but in this example, the ground pad 126 is disposed on a backside of the disc 142 so that the disc 142 separates the microstrip 121 from the ground pad 126. The transmission line 132 includes a ground (or shield) that is coupled to the ground pad 126 at the small ring 130 and a core 127 that extends through the disc 142 and is coupled to the microstrip 121 at the input 128. Either of the embodiments shown in FIG. 9 or 17 may be used with any of the connected-slot antennas described herein.

The example shown in FIG. 17 eliminates the dielectric 124 that is included in the example shown in FIG. 9. This can improve alignment between the various conductive features (e.g., the frontside patch, the ring, the microstrip, and/or the ground pad). Improving alignment improves phase center stability and reduces operating frequency variation. In some embodiments, the ground pad 126 is disposed on a backside of the substrate 102 and aligned with a backside patch (e.g., one of the patches 110 on the backside of the substrate 102). In these embodiments, the backside patch may function as or replace the ground pad 126.

In some embodiments, the microstrip 121 and the ring may be on the same plane (e.g., on a surface of the substrate 102). If an arrangement of the microstrip 121 and a circumference of the ring are such that the microstrip 121 and ring overlap (as shown in FIG. 8*a*), the ring can be discontinuous across the surface of the substrate 102 to provide electrical isolation between the ring and microstrip 121.

Some embodiments may replace the ring with a discontinuous ring. The discontinuous ring may be formed by discrete elements on a surface of a substrate that are connected to ground.

The ground connection may be provided by a shield (or ground) of a transmission line or by an electrical connection to a ground plane. Using a discontinuous ring may increase gain in GNSS frequency bands of approximately 1.164-1.30 GHz and 1.525-1.614 GHz.

Figure 18:
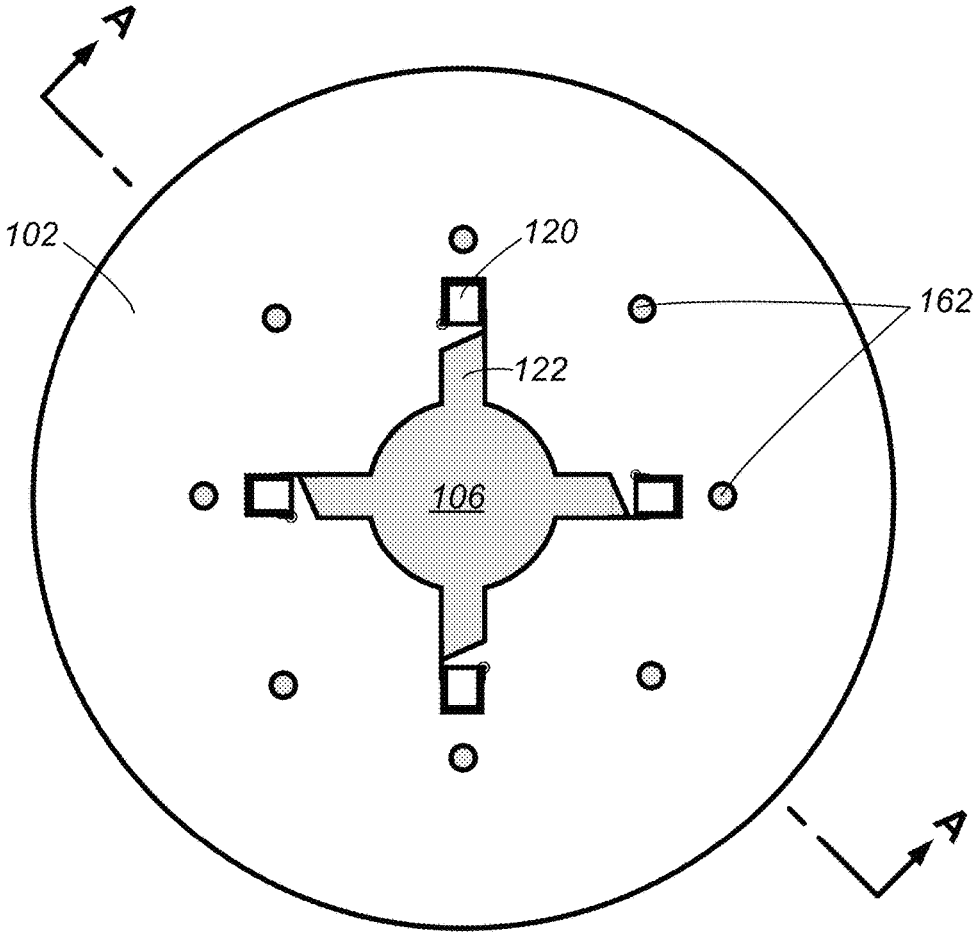
FIG. 18 is a simplified top view of a connected-slot antenna in accordance with another embodiment.

An example of a discontinuous ring is shown in FIG. 18, which is a simplified top view of a connected-slot antenna in accordance with an embodiment. This example includes a frontside patch 106 with elongated portions 122 and impedance transformers 120 on a substrate 102. This example also includes discrete elements 162 surrounding the frontside patch 106 in a discontinuous ring.

Figure 19:
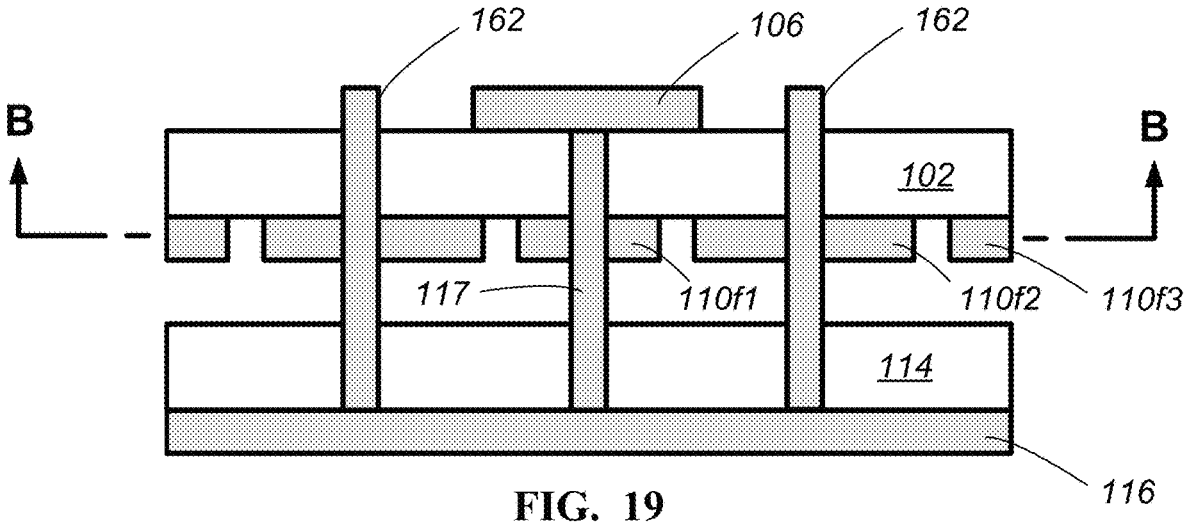
FIG. 19 is a simplified cross section along line A-A of the connected-slot antenna shown in FIG. 18 in accordance with an embodiment.

FIG. 19 is a simplified cross section along line A-A of the connected-slot antenna shown in FIG. 18. This figure shows the frontside patch 106 on a frontside of the substrate 102 and backside patches 110*f*1, 110*f*2, 110*f*3 on a backside of the substrate 102. The backside patches may be arranged in a pattern that provides circular symmetry similar to the examples shown in FIGS. 3-4. FIG. 19 also shows a dielectric 114, a ground plane 116, and a via 117. This figure also shows discrete elements 162 coupled with the ground plane 116. In this example, the discrete elements 162 may comprise vias extending between the frontside of the substrate 102 and the ground plane 116. The discrete elements 162 may also be elements that are electrically connected to a shield (or ground) of a transmission line. The discrete elements 162 may comprise pins, fasteners, or other connectors that function to hold features of the connected-slot antenna together. The example shown in this figure may include a fence (described below) in some embodiments.

Figure 20:
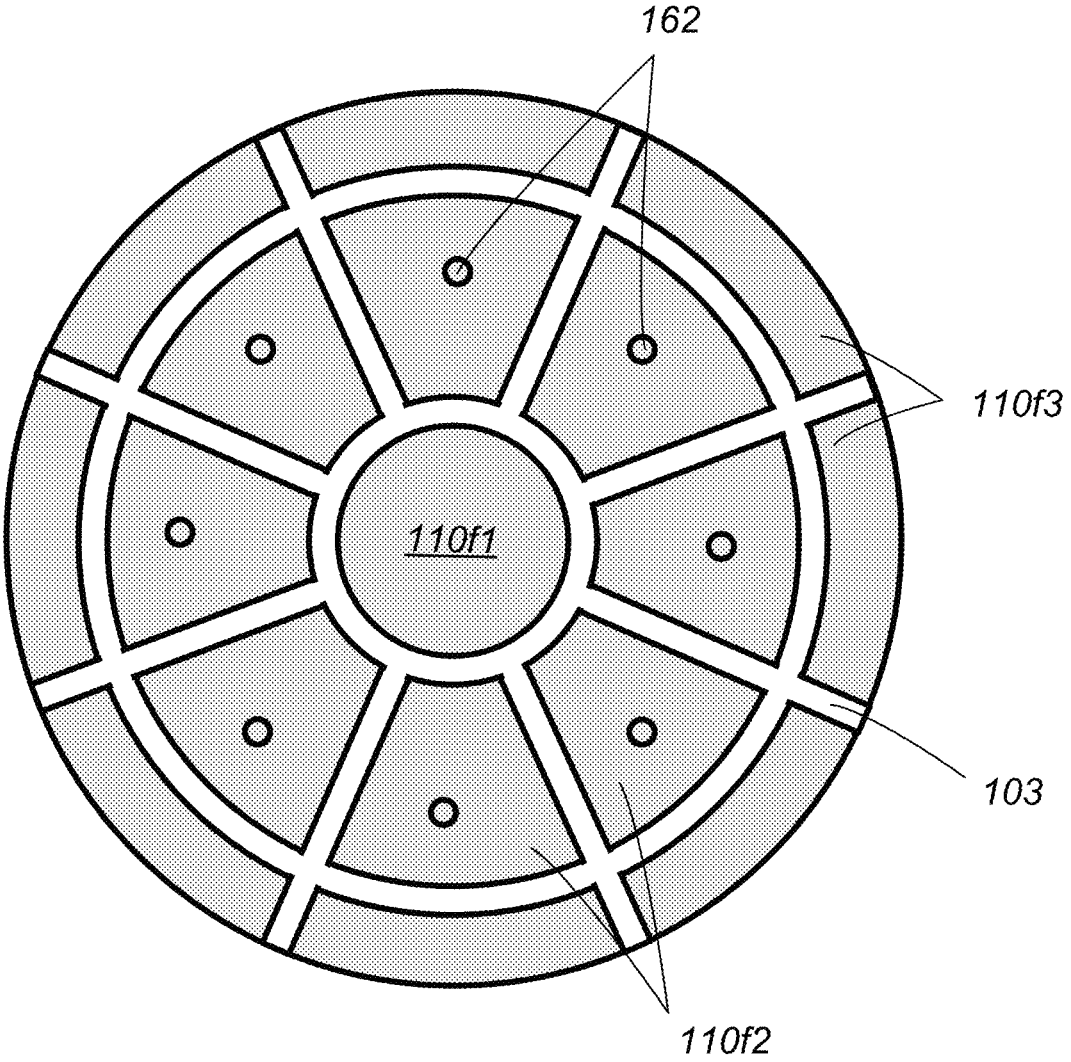
FIG. 20 is a simplified bottom view along line B-B of the connected-slot antenna shown in FIG. 19 in accordance with an embodiment.

FIG. 20 is a simplified bottom view along line B-B of the connected-slot antenna shown in FIG. 19. This figure shows the backside patches 110*f*1, 110*f*2, 110*f*3 and the discrete elements 162. The backside patches 110*f*2 and the discrete elements 162 may be electrically coupled in some embodiments. The backside patches may have different shapes as described previously. The discontinuous ring may be used in place of a continuous ring in any of the embodiments described herein. The intermediate backside patches 110*f*2 that are opposite (or below) the impedance transformers 120 may function as a ground pad for the impedance transformers 120.

Figure 21:
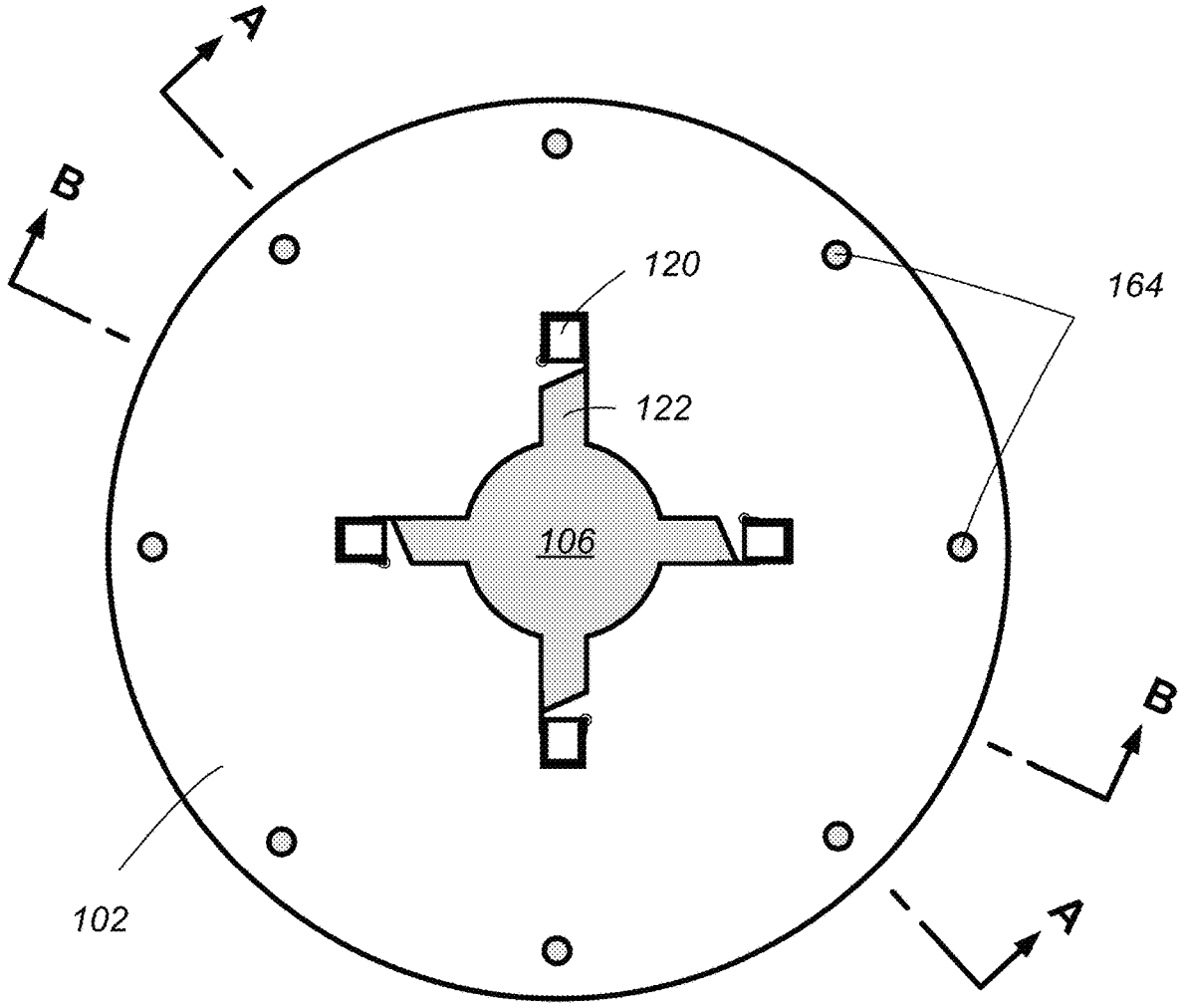
FIG. 21 is a simplified top view of a connected-slot antenna in accordance with another embodiment.

FIG. 21 is a simplified top view of a connected-slot antenna in accordance with another embodiment. This example includes a frontside patch 106 with elongated portions 122 and impedance transformers 120 on a substrate 102. This example also includes discrete elements 164 surrounding the frontside patch 106 in a discontinuous ring. The discrete elements 164 couple the substrate 102 to cavity 109 (shown in FIGS. 22-23).

Figure 22:
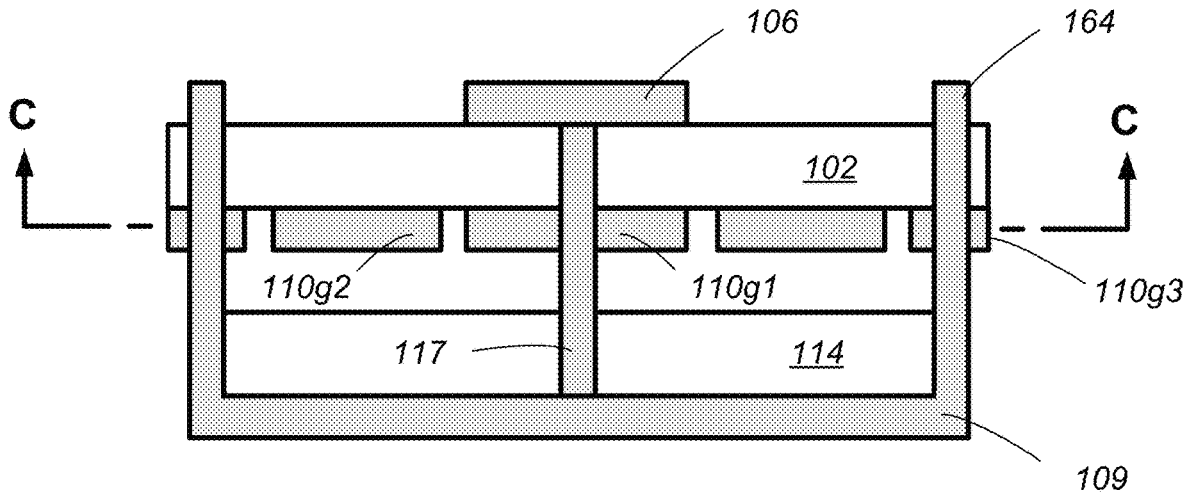
FIG. 22 is a simplified cross section along line A-A.

FIG. 22 is a simplified cross section along line A-A of the connected-slot antenna shown in FIG. 21. This figure shows the frontside patch 106 on a frontside of the substrate 102 and backside patches 110*g*1, 110*g*2, 110*g*3 on a backside of the substrate 102. This figure also shows discrete elements 164 extending through the outer backside patches 110*g*3 and the substrate 102. The discrete elements 164 form an upper part of a cavity 109. The discrete elements 164 may be integrated with the cavity 109 to form a single component, or they may be separate elements that are coupled to the cavity 109. Similarly, the cavity may be a single integrated component or a combination of multiple components (e.g., a ground plane surrounded by a fence).

The cavity 109 may be part of a metamaterial ground plane (along with the backside patches). The cavity 109 can eliminate discontinuities at the edges of the backside patches. This can reduce residual surface waves by shorting them to ground. The cavity 109 can improve LHCP isolation, low elevation angle sensitivity, antenna bandwidth, and multipath resilience.

The discrete elements 164 and the cavity 109 may each comprise a conductive material such as a metal or alloy and may be electrically grounded. The cavity 109 may provide a ground plane for the connected-slot antenna. The discrete elements 164 may comprise vias extending between the frontside of the substrate 102 and the cavity 109. In embodiments where the discrete elements 164 are separate elements from the cavity 109, the discrete elements 164 may comprise pins, fasteners, or other connectors that function to hold features of the connected-slot antenna together (e.g., couple the cavity 109 to the substrate 102).

Figure 23:
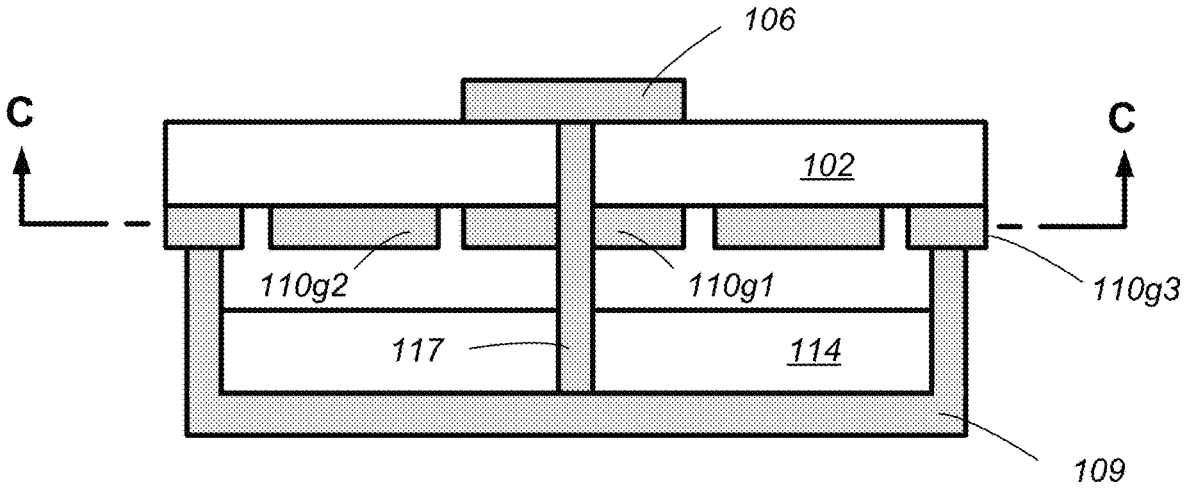
FIG. 23 is a simplified cross section along line B-B, of the connected-slot antenna shown in FIG. 21 in accordance with some embodiments.

FIG. 23 is a simplified cross section along line B-B of the connected-slot antenna shown in FIG. 21. This figure shows an upper part of the cavity 109 abutting outer backside patches 110*g*3. These figures also show via 117 and dielectric 114 similar to other figures. In some embodiments, the dielectric 114 may comprise air or the via 117 may extend to the dielectric 114 rather than through the dielectric 114 as shown in these examples. Also, in some embodiments, the via 117 may only extend to the center backside patch (rather than through the substrate 102).

Figure 24:
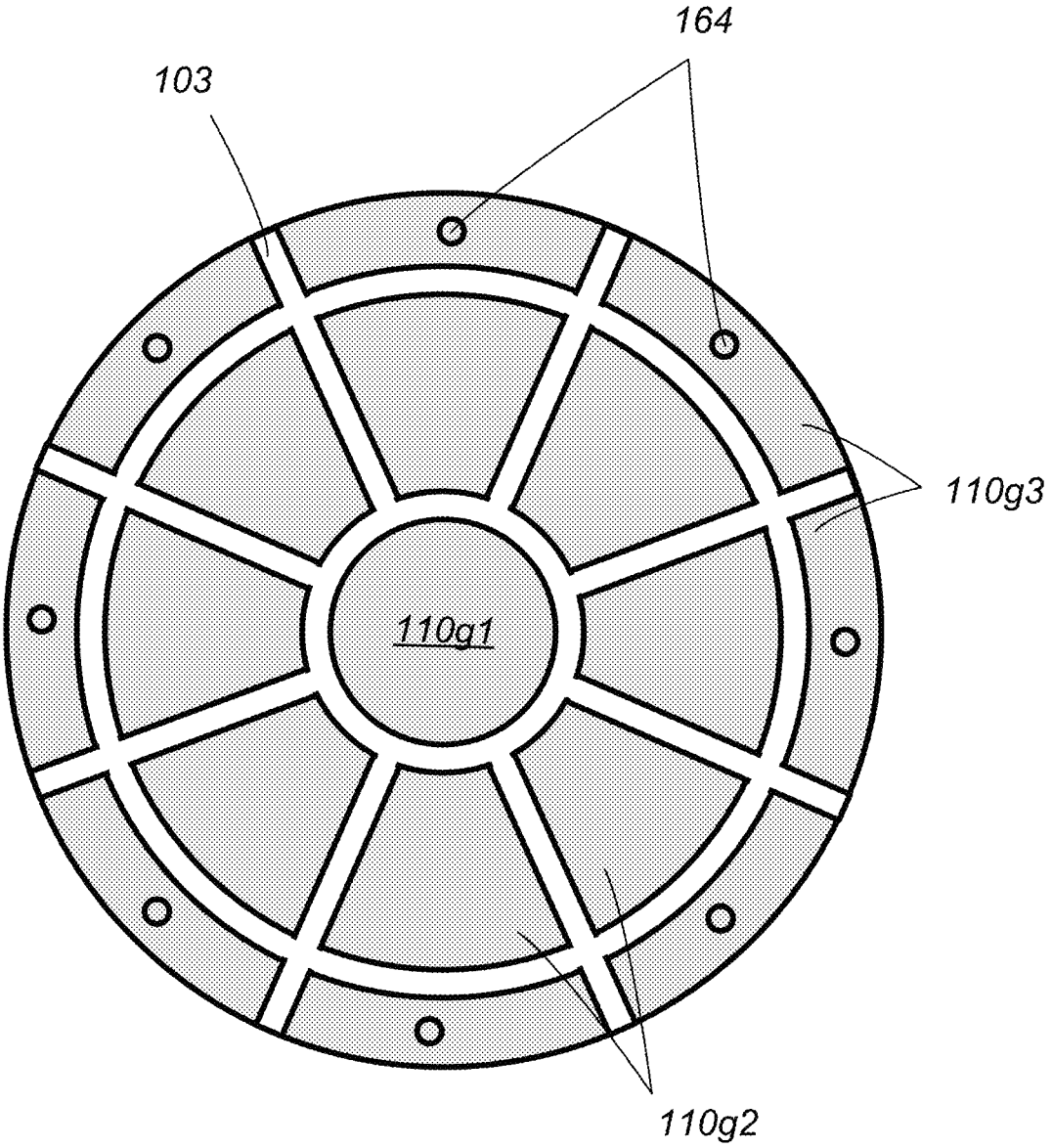
FIG. 24 is a simplified bottom view along line C-C of the connected-slot antenna shown in FIGS. 22-23 in accordance with some embodiments.

FIG. 24 is a simplified bottom view along line C-C of the connected-slot antenna shown in FIGS. 22-23. This figure shows the backside patches 110*g*1, 110*g*2, 110*g*3 and the discrete elements 164. The backside patches 110*g*1, 110*g*2, 110*g*3 are arranged in a pattern that provides circular symmetry similar to the examples shown in FIGS. 3-4. The outer backside patches 110*g*3 and the discrete elements 164 may be electrically coupled in some embodiments. The backside patches 110*g*1, 110*g*2, 110*g*3 are separated from each other by a spaces 103. The spaces 103 may include air or another dielectric. The backside patches 110*g*1, 110*g*2, 110*g*3 may have different shapes as described previously. The intermediate backside patches 110*g*2 that are opposite (or below) the impedance transformers 120 may function as a ground pad for the impedance transformers 120. The intermediate backside patches 110*g*2 that are not opposite the impedance transformers (or are not below the impedance transformers) may be electrically floating.

Figure 25:
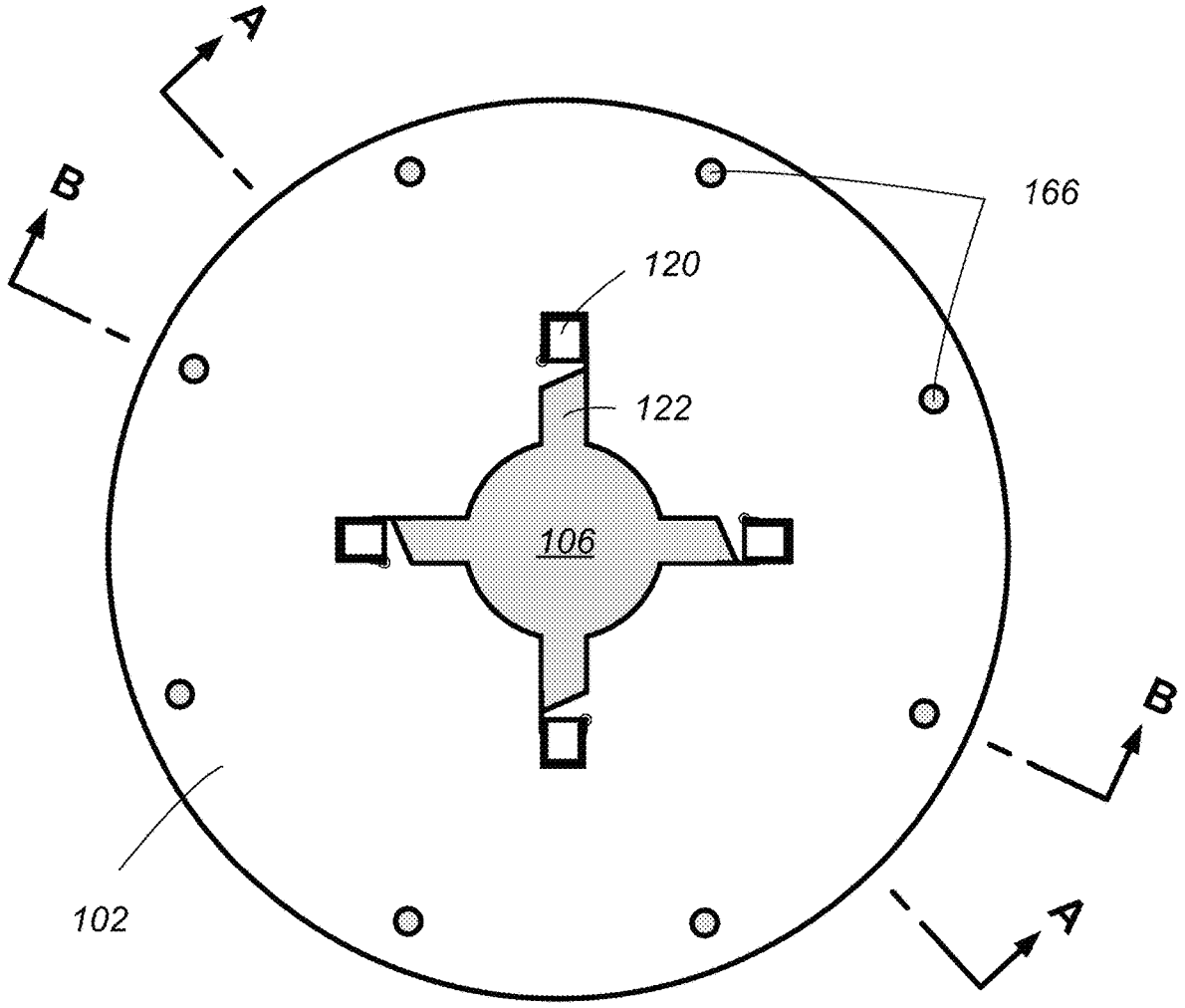
FIG. 25 is a simplified top view of a connected-slot antenna in accordance with another embodiment.

FIG. 25 is a simplified top view of a connected-slot antenna in accordance with another embodiment. This example includes a frontside patch 106 with elongated portions 122 and inpedance transformers 120 on a substrate 102. This example also includes discrete elements 166 surrounding the frontside patch 106 in a discontinuous ring. The discrete elements 166 are similar to the discrete elements 164 shown in FIG. 21. The discrete elements 166, however, are not aligned with elongated sections 122 in the same manner as the discrete elements 164.

Instead, the discrete elements 166 are offset from the elongated sections 122, whereas some of the discrete elements 164 shown in FIG. 21 are aligned with the elongated sections.

Figure 26:
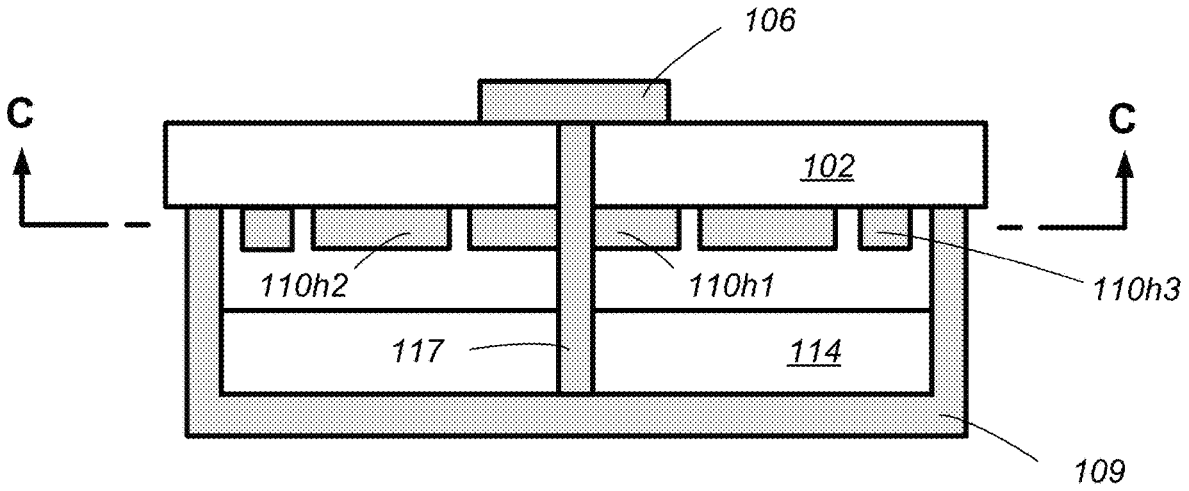
FIG. 26 is a simplified cross section along line A-A.
Figure 28:
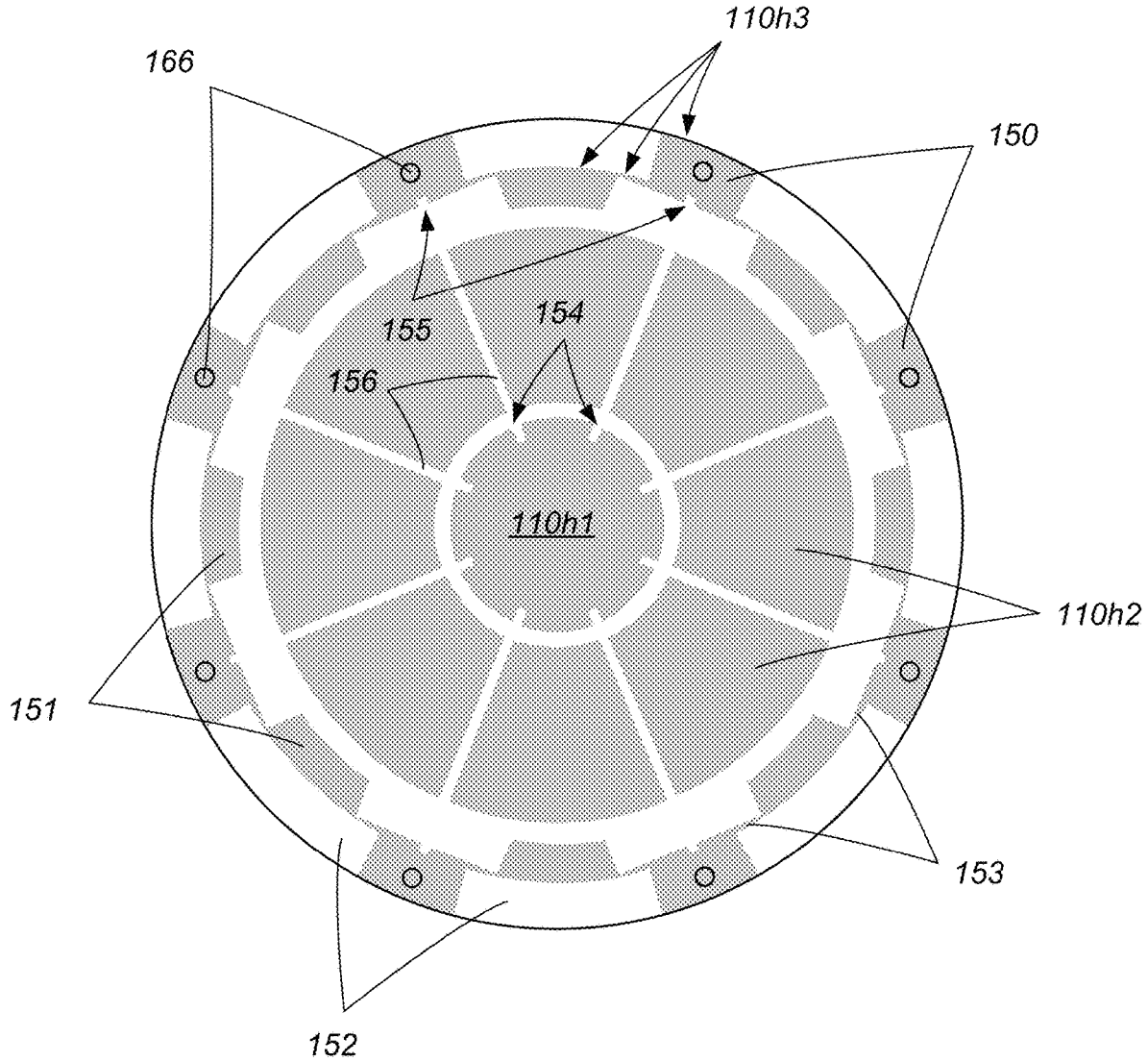
FIG. 28 is a simplified bottom view along line C-C of the connected-slot antenna shown in FIGS. 26-27 in accordance with some embodiments.

FIG. 26 is a simplified cross section along line A-A of the connected-slot antenna shown in FIG. 25. This figure shows the frontside patch 106 on a frontside of the substrate 102 and backside patches 110*h*1, 110*h*2, 110*h*3 on a backside of the substrate 102. This figure also shows an upper part of cavity 109 abutting a backside of the substrate 102. The upper part of the cavity 109 is spaced from the outer backside patch 110*h*3 in this example. FIG. 28 (described below) shows that the outer backside patch 110*h*3 includes portions that extend to outer edges of the substrate 102 and portions that are isolated or spaced from the outer edges of the substrate 102. In this example, the portions of the outer backside patch 110*h*3 that are isolated from the outer edges of the substrate are not directly coupled to the cavity 109.

Figure 27:
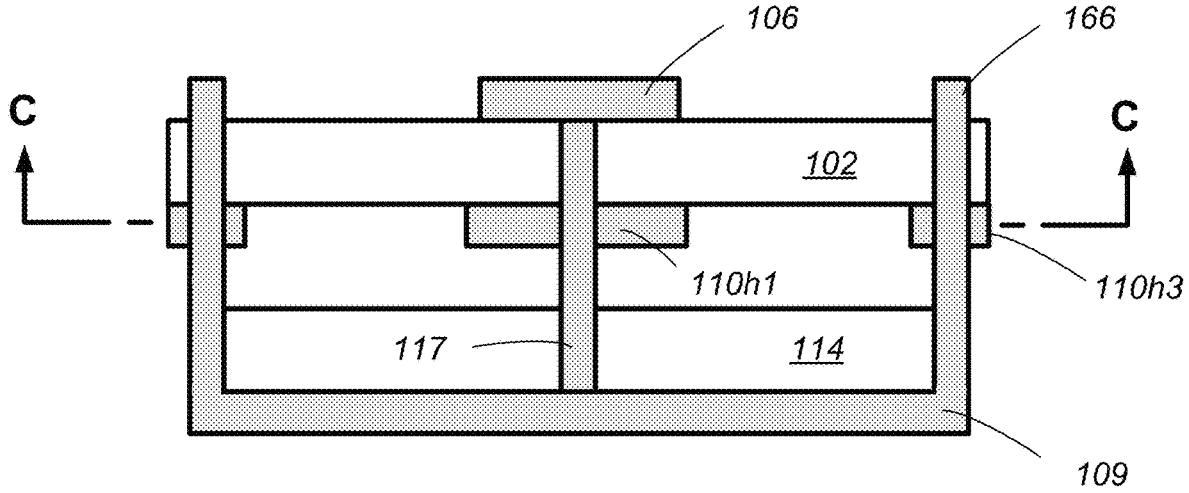
FIG. 27 is a simplified cross section along line B-B, of the connected-slot antenna shown in FIG. 25 in accordance with some embodiments.

FIG. 27 is a simplified cross section along line B-B of the connected-slot antenna shown in FIG. 25. This figure shows the frontside patch 106 on a frontside of the substrate 102 and backside patches 110*h*1, 110*h*3 on a backside of the substrate 102. This figure also shows discrete elements 166 extending through the outer backside patch 110*h*3 and the substrate 102 to form an upper part of the cavity 109. Similar to the discrete elements 164 shown in FIG. 21, the discrete elements 166 may be integrated with the cavity 109 to form a single component or they may be separate elements that are coupled to the cavity 109. The discrete elements 166 may comprise vias extending between the frontside of the substrate 102 and the cavity 109. In embodiments where the discrete elements 166 are separate elements from the cavity 109, the discrete elements 166 may comprise pins, fasteners, or other connectors that function to hold features of the connected-slot antenna together (e.g., couple the cavity 109 to the substrate 102).

FIG. 27 shows that portions of the outer backside patch 110*h*3 that extend to outer edges of the substrate 102 are directly coupled to the cavity 109. The intermediate backside patches 110*h*2 are not shown in this example because, as can be seen in FIG. 28, the discrete elements 166 are aligned with spaces 156. The example shown in FIG. 27 is a cross section along one of the spaces 156.

FIG. 28 is a simplified bottom view along line C-C of the connected-slot antenna shown in FIGS. 26-27. This figure shows the backside patches 110*h*1, 110*h*2, 110*h*3 and the discrete elements 166. The backside patches 110*h*1, 110*h*2, 110*h*3 may each comprise a conductive material such as a metal or alloy and may be etched from a metal foil in accordance with known PCB processing techniques. The backside patches 110*h*1, 110*h*2 are arranged in a pattern that provides circular symmetry similar to the backside patches 110*a*1, 110*a*2 shown in FIG. 5.

The outer backside patch **110*h*3 has a ring-shape that extends around the intermediate backside patches 110*h*2. The outer backside patch 110*h*3 is not circular symmetric with respect to a center of the connected-slot antenna. The outer backside patch 110*h*3 includes portions 150 that extend radially to an outer edge of the substrate and portions 151 that are isolated from the outer edge of the substrate. The portions 150 and the portions 151 are connected by connector portions 153**.

The intermediate backside patches **110*h*2 are each isolated from each other by spaces 156. Portions 150 of the outer backside patch 110*h*3 that extend to the outer edge of the substrate are positioned radially outward from one of the spaces 156 between adjacent ones of the intermediate backside patches 110*h*2. The spaces 156 may extend radially inward into the center backside patch 110*h*1 to form notches 154, and the spaces 156 may extend radially outward into the portions 150 of the outer backside patch 110*h*3 to form notches 155. The intermediate backside patches 110*h*2 that are opposite (or below) the impedance transformers 120 may function as a ground pad for the impedance transformers 120. The intermediate backside patches 110*h*2** that are not opposite (or are not below) the impedance transformers may be electrically floating.

Figure 29:
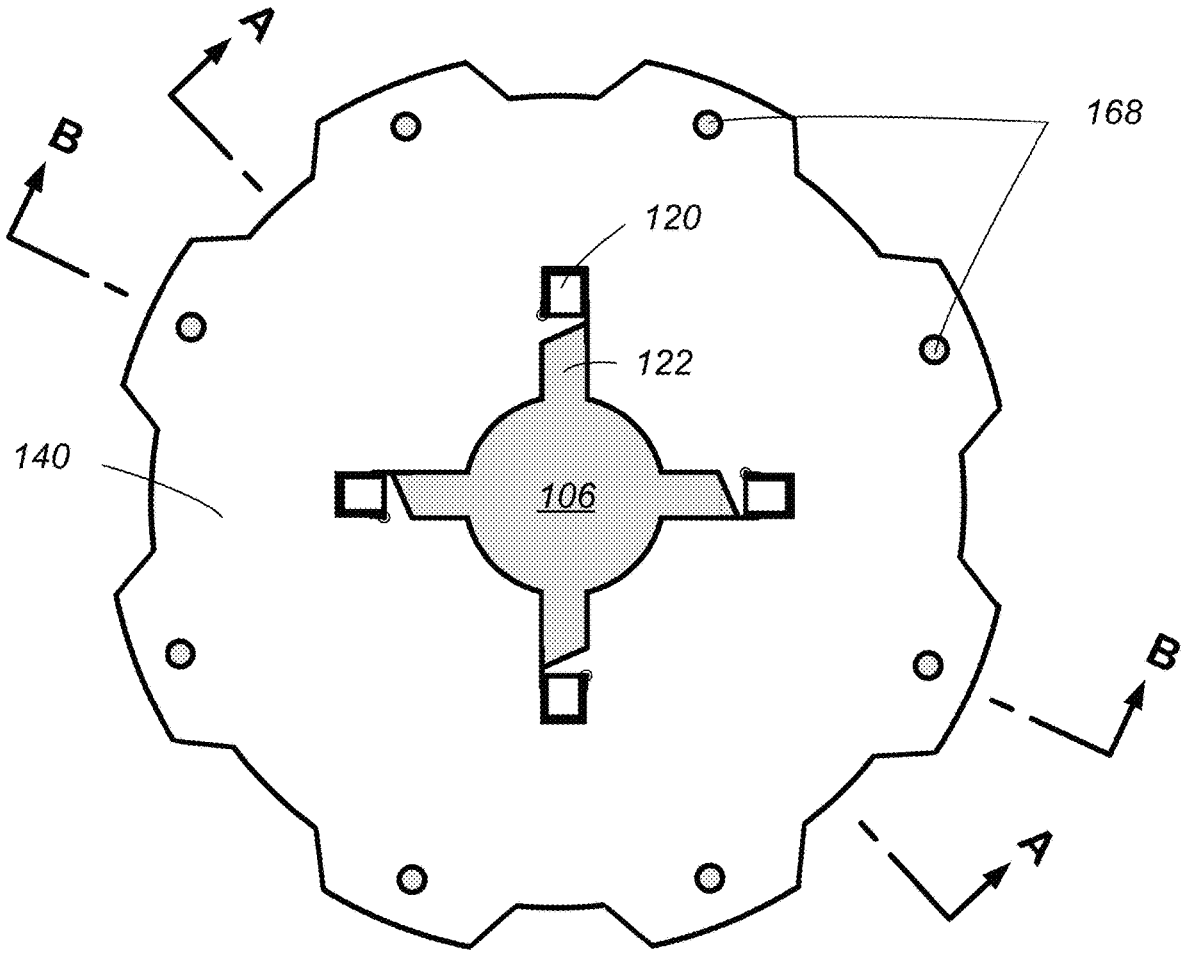
FIG. 29 is a simplified top view of a connected-slot antenna in accordance with another embodiment.

FIG. 29 is a simplified top view of a connected-slot antenna in accordance with another embodiment. This example includes a frontside patch 106 with elongated portions 122 and inpedance transformers 120 on a substrate 140. This example also includes discrete elements 168 surrounding the frontside patch 106 in a discontinuous ring. The discrete elements 168 are similar to the discrete elements 166 shown in FIG. 25. In this embodiment, the substrate 140 has a circular shape with some edges of the substrate 140 protruding outward farther than at least some adjacent edges of the substrate 140. The discrete elements 168 are disposed in portions of the substrate 140 that are formed by the outward protruding edges. The shape of the substrate 140 can reduce size and weight compared to conventional connected-slot antennas. The reduction in size and weight can also reduce manufacturing costs.

Figure 30:
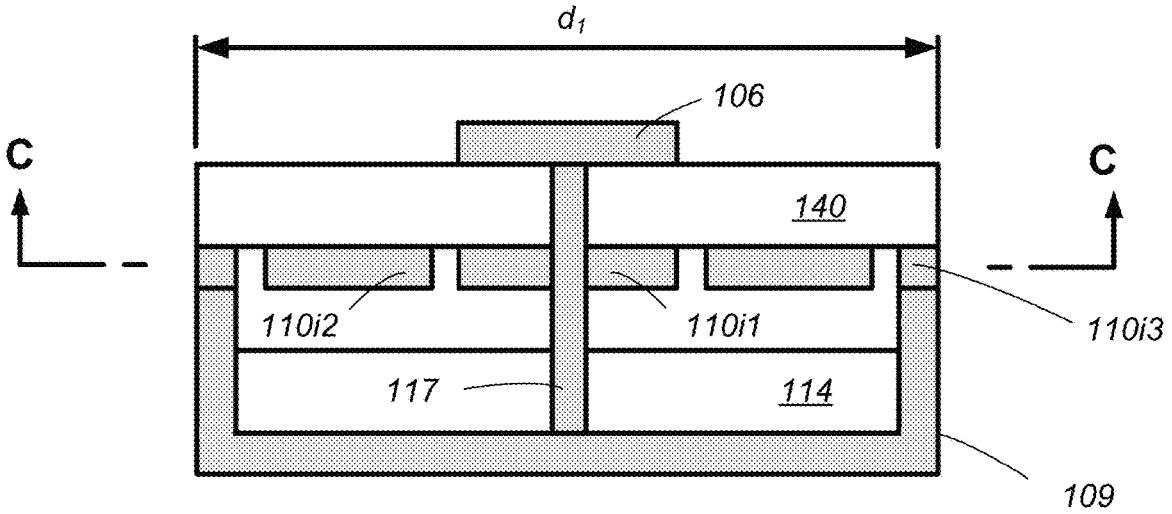
FIG. 30 is a simplified cross section along line A-A.

FIG. 30 is a simplified cross section along line A-A of the connected-slot antenna shown in FIG. 29. This figure shows the frontside patch 106 on a frontside of the substrate 140 and backside patches **110*i*1, 110*i*2, 110*i*3 on a backside of the substrate 140. This figure also shows an upper part of cavity 109 abutting outer backside patch 110*i*3**. In this example, a diameter of the cavity is approximately the same as a diameter of the substrate. This is not required, however, and in some embodiments, the diameter of the cavity may be smaller than a diameter of the substrate (e.g., sidewalls of the cavity may not extend to outer edges of the substrate). Further, the sidewalls of the cavity may be angled rather than vertical as shown in this example.

Figure 31:
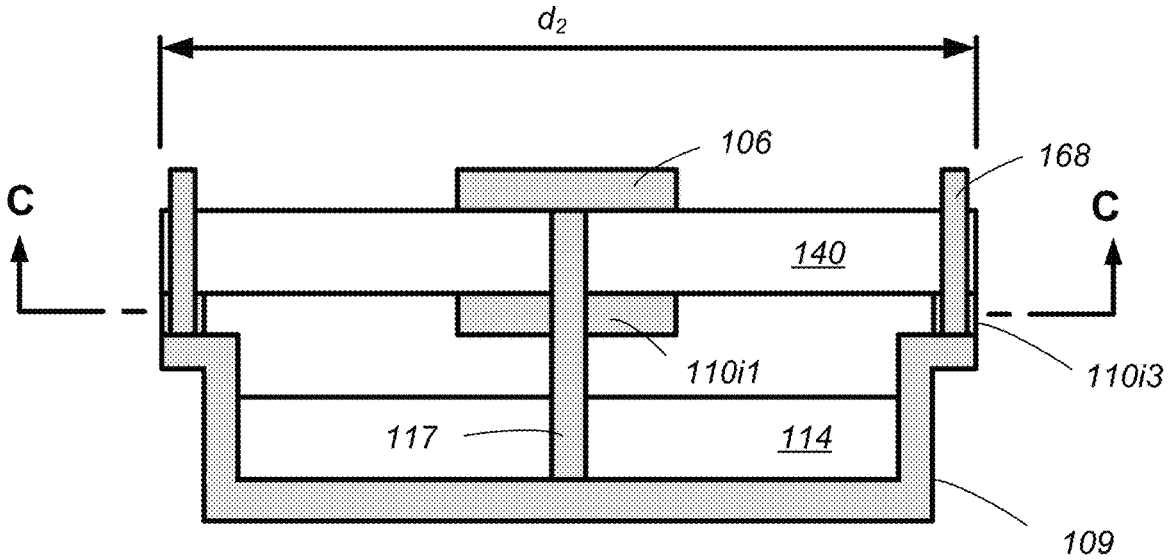
FIG. 31 is a simplified cross section along line B-B, of the connected-slot antenna shown in FIG. 29 in accordance with some embodiments.

FIG. 31 is a simplified cross section along line B-B of the connected-slot antenna shown in FIG. 29. This figure shows the frontside patch 106 on a frontside of the substrate 140 and backside patches **110*i*1, 110*i*3 on a backside of the substrate 140. This figure also shows discrete elements 168 extending through the outer backside patch 110*i*3 and the substrate 140. In this example, the discrete elements 168 are coupled to the cavity 109. In some embodiments, the discrete elements 168 may be integrated with the cavity 109. The discrete elements 168 may comprise vias extending between the frontside of the substrate 140 and the cavity 109. The discrete elements 168 may comprise pins, fasteners, or other connectors that function to hold features of the connected-slot antenna together (e.g., couple the cavity 109 to the substrate 140). The discrete elements 168 may be electrically coupled to the cavity 109 and the outer backside patch 110*i*3**.

In FIG. 30 the substrate 140 has a diameter $d_1$, and in FIG. 31 the substrate has a diameter $d_2$. The cross section shown in FIG. 31 includes the outward protruding edges of the substrate 140 shown in FIG. 29. These outward protruding edges results in the diameter $d_2$ being larger than the diameter $d_1$. In FIG. 31, an upper portion of the cavity 109 has a lip where the cavity 109 is coupled to the discrete elements 168. A diameter of vertical sidewalls of the cavity 109 may be similar in both figures.

Figure 32:
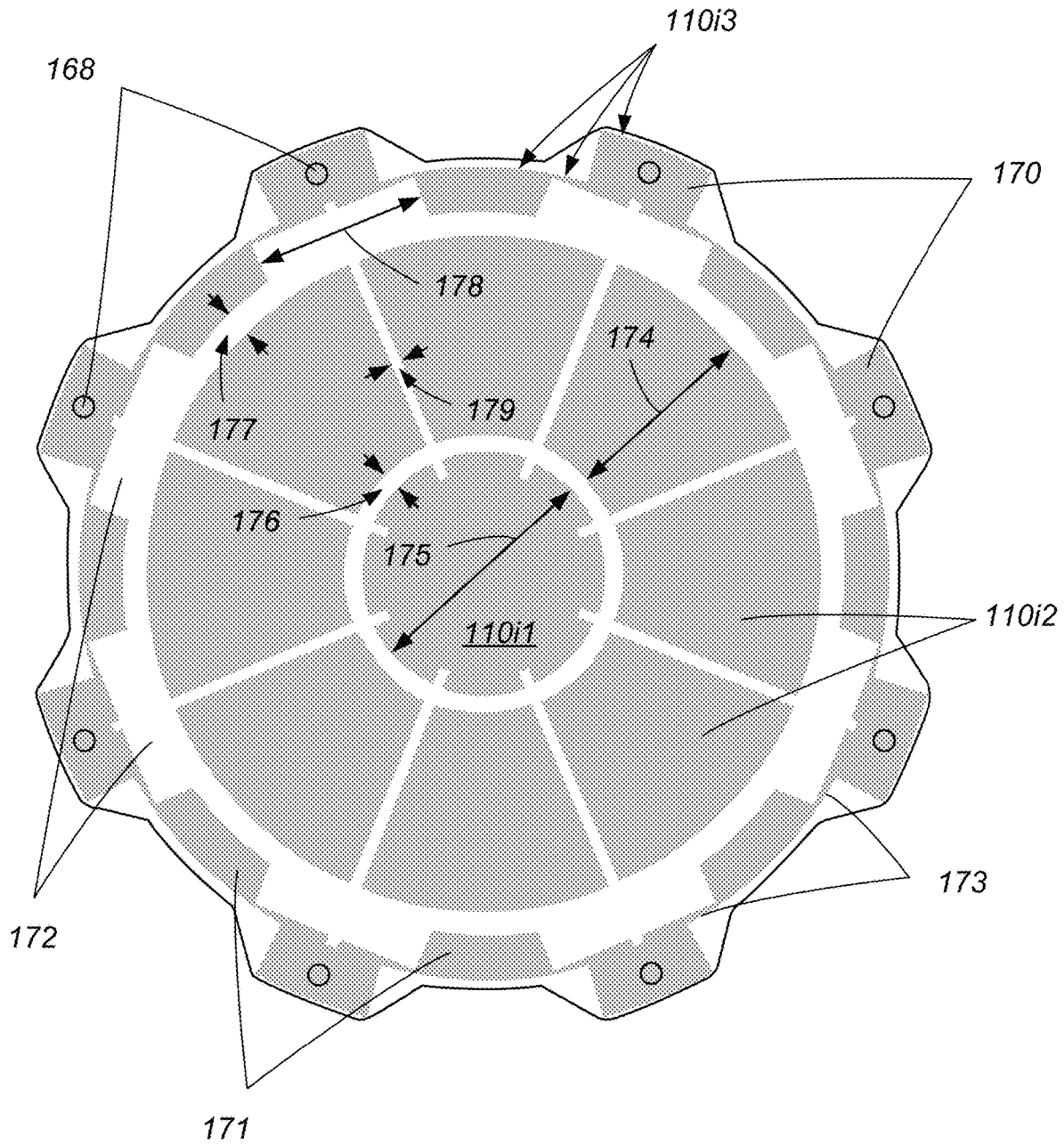
FIG. 32 is a simplified bottom view along line C-C of the connected-slot antenna shown in FIGS. 30-31 in accordance with some embodiments.

FIG. 32 is a simplified bottom view along line C-C of the connected-slot antenna shown in FIGS. 30-31. This figure shows the backside patches **110*i*1, 110*i*2, 110*i*3 and the discrete elements 168. The backside patches 110*i*1, 110*i*2, 110*i*3 may each comprise a conductive material such as a metal or alloy and may be etched from a metal foil in accordance with known PCB processing techniques. The backside patches 110*i*1, 110*i*2 are arranged in a pattern that provides circular symmetry similar to the backside patches 110*a*1, 110*a*2 shown in FIG. 5**.

The outer backside patch **110*i*3 has a ring-shape that extends around the intermediate backside patches 110*i*2. The outer backside patch 110*h*3 is not circular symmetric with respect to a center of the connected-slot antenna. The outer backside patch 110*i*3 includes portions 170 that extend radially outward to an outer edge of the substrate and portions 171 that extend radially inward from the outer edge of the substrate. The portions 170 may extend radially outward to an outer edge of outward protruding portions of the substrate, and the portions 171 may extend radially inward from an outer edge of recessed portions of the substrate. The portions 170 and the portions 171 may be coupled by connector portions 173**.

The intermediate backside patches **110*i*1, 110*i*2, 110*i*3 are each isolated from each other by spaces. The center backside patch 110*i*1 is separated from each of the intermediate backside patches 110*i*2 by a first space 176, and each of the intermediate backside patches 110*i*2 are separated from adjacent ones of the intermediate backside patches 110*i*2 by a second space 179** that extends radially outward.

The outer backside patch **110*i*3 extends radially outward to the outer edge of the outward protruding portions of the substrate in some areas, and extends radially inward from the recessed portions of the substrate in other areas. The areas of the outer backside patch 110*i*3 that extend inward from the recessed portions of the substrate are each separated from an adjacent one of the intermediate backside patches 110*i*2 by a third space 177**.

Areas of the outer backside patch **110*i*3 that extend radially inward from the recessed portions of the substrate are separated from one another by a fourth space 178**.

In some embodiments, a width of the first space 176, the second space 179, the third space 177, and the fourth space 178 are all approximately equal. In other embodiments, the width of at least some of the spaces may not be equal. For example, in an embodiment, at least one of the first space 176 is greater than the second space 179, the third space 177 is greater than the first space 176, or the fourth space 178 is greater than the second space 179. Portions 170 of the outer backside patch **110*i*3 that extend to the outer edge of the substrate are positioned radially outward from one of the spaces 179. Changing the width of the spaces can shift frequency response of the metamaterial ground plane and adjust coupling to the cavity 109**.

In the example shown in FIG. 32, the center backside patch **110*i*1 has a diameter 175 and each of the intermediate backside patches 110*i*2 has a radial width 174. The diameter 175 of the center backside patch 110*i*1 may be less than, equal to, or greater than the radial width 174 of the intermediate backside patches 110*i*2** depending on the particular embodiment.

The intermediate backside patches **110*i*2 that are opposite (or below) the impedance transformers 120 may function as a ground pad for the impedance transformers 120. The intermediate backside patches 110*i*2** that are not opposite (or are not below) the impedance transformers may be electrically floating.

Figure 33:
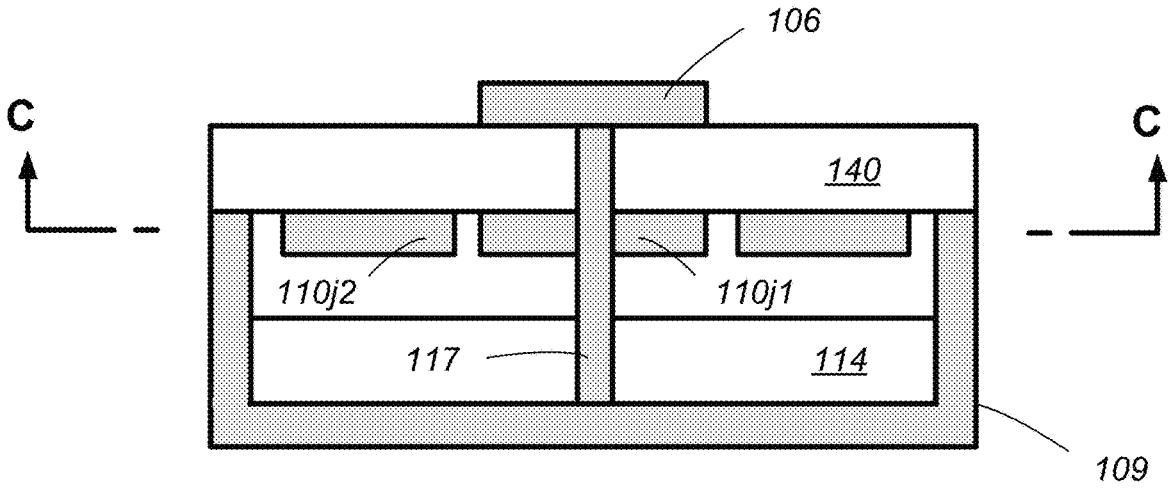
FIG. 33 is a simplified cross section along line A-A of the connected-slot antenna shown in FIG. 29 in accordance with another embodiment.
Figure 34:
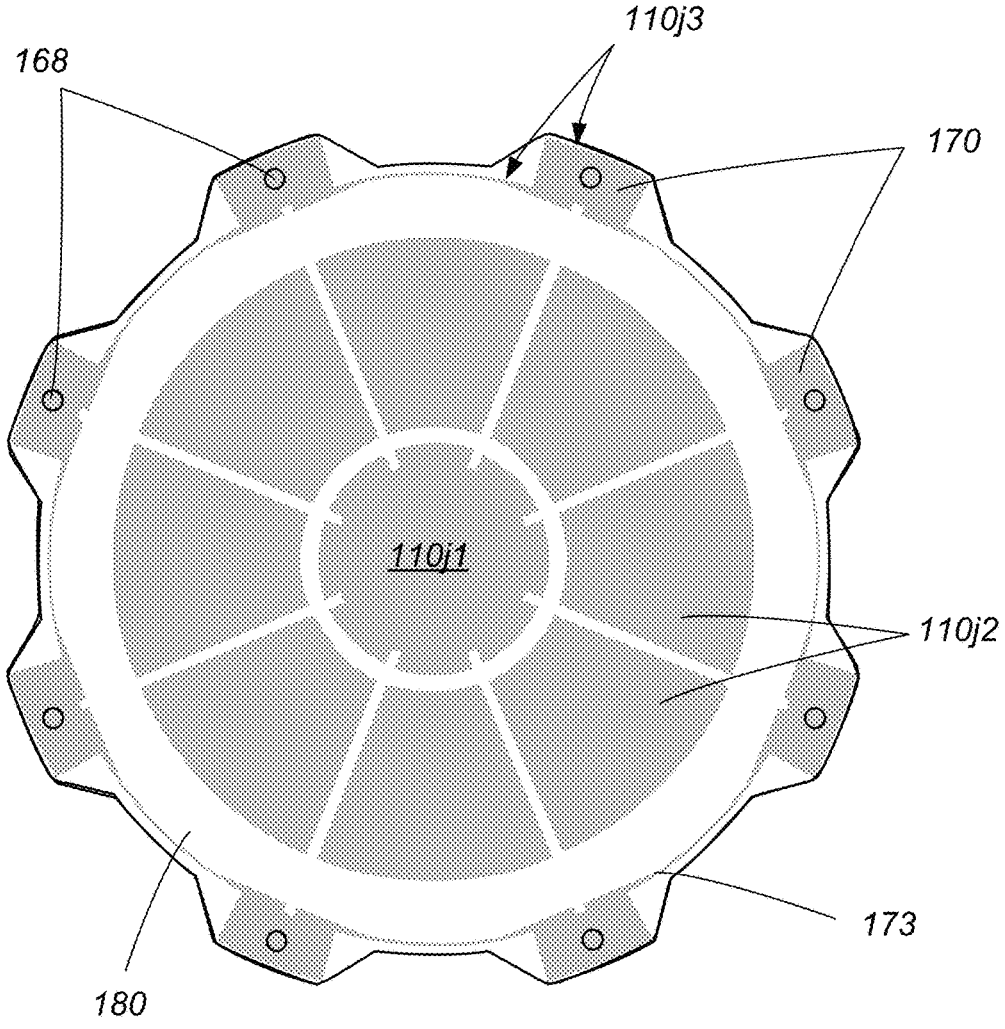
FIG. 34 is a simplified bottom view along line C-C of the connected-slot antenna shown in FIG. 33 in accordance with another embodiment.

FIG. 33 is a simplified cross section along line A-A of the connected-slot antenna shown in FIG. 29, and FIG. 34 is a simplified bottom view along line C-C of the connected-slot antenna shown in FIG. 33.

FIG. 33 shows the frontside patch 106 on a frontside of the substrate 140 and backside patches **110*j*1, 110*j*2 on a backside of the substrate 140. FIG. 34 shows backside patches 110*j*1, 110*j*2, 110*j*3 and discrete elements 168. The backside patches 110*j*1, 110*j*2, 110*j*3 may each comprise a conductive material such as a metal or alloy and may be etched from a metal foil in accordance with known PCB processing techniques. The backside patches 110*j*1, 110*j*2 are arranged in a pattern that provides circular symmetry similar to the backside patches 110*a*1, 110*a*2 shown in FIG. 5**.

As shown in FIG. 34, the intermediate backside patches **110*j*2 are separated from the outer backside patch 110*j*3 by a space 180. The outer backside patch 110*j*3 does not include portions that extend radially inward from recessed portions of the substrate like the example shown in FIG. 32. As a result, FIG. 33 shows an upper part of cavity 109 abutting the substrate (rather than abutting the outer backside patch 110*j*3). Portions 170 of the outer backside patch 110*j*3 may be coupled by connector portions 173 (not shown in FIG. 33**).

Figure 35:
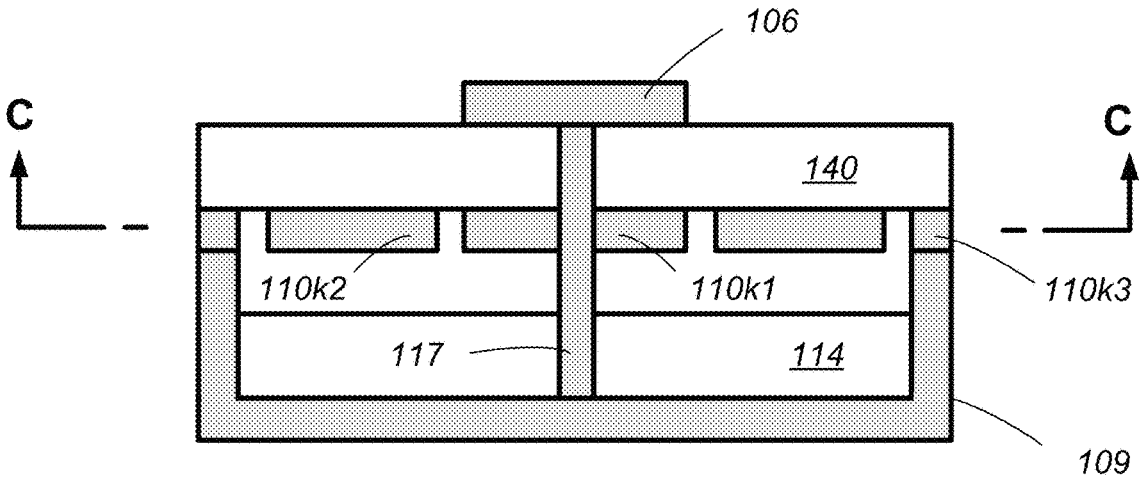
FIG. 35 is a simplified cross section along line A-A of the connected-slot antenna shown in FIG. 29 in accordance with another embodiment.
Figure 36:
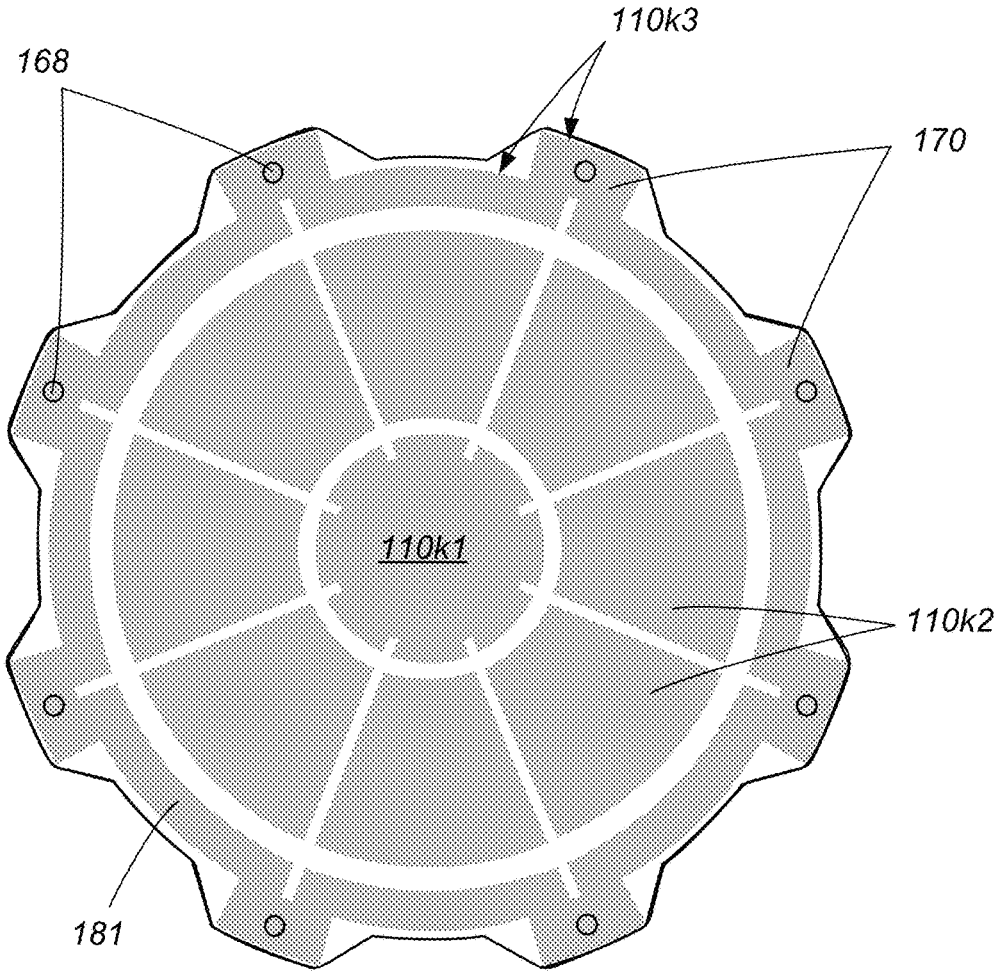
FIG. 36 is a simplified bottom view along line C-C of the connected-slot antenna shown in FIG. 35 in accordance with another embodiment.

FIG. 35 is a simplified cross section along line A-A of the connected-slot antenna shown in FIG. 29, and FIG. 36 is a simplified bottom view along line C-C of the connected-slot antenna shown in FIG. 35.

FIG. 35 shows the frontside patch 106 on a frontside of the substrate 140 and backside patches **110*k*1, 110*k*2, 110*k*3 on a backside of the substrate 140. FIG. 36 shows backside patches 110*k*1, 110*k*2, 110*k*3 and discrete elements 168. The backside patches 110*k*1, 110*k*2, 110*k*3 may each comprise a conductive material such as a metal or alloy and may be etched from a metal foil in accordance with known PCB processing techniques. The backside patches 110*k*1, 110*k*2 are arranged in a pattern that provides circular symmetry similar to the backside patches 110*a*1, 110*a*2 shown in FIG. 5**.

As shown in FIG. 36, the outer backside patch **110*k*3 includes a ring portion 181. As a result, FIG. 35 shows an upper part of cavity 109 abutting the outer backside patch 110*k*3**.

While the present invention has been described in terms of specific embodiments, it should be apparent to those skilled in the art that the scope of the present invention is not limited to the embodiments described herein. For example, features of one or more embodiments of the invention may be combined with one or more features of other embodiments without departing from the scope of the invention. The specification and drawings are, accordingly, to be regarded in an illustrative rather than a restrictive sense. Thus, the scope of the present invention should be determined not with reference to the above description, but should be determined with reference to the appended claims along with their full scope of equivalents.

What is claimed is:

1. An antenna configured to receive global navigation satellite system (GNSS) signals, comprising:

a substrate having a front side and a backside opposite the front side, and wherein the substrate includes outward protruding portions and recessed portions;

a frontside patch arranged on the front side of the substrate, the frontside patch configured as a radiating element;

one or more antenna feeds electrically coupled to the frontside patch; and a metamaterial ground plane comprising:

a plurality of backside patches arranged on the backside of the substrate and separated from the frontside patch by the substrate, wherein the plurality of backside patches include a center backside patch surrounded in a radial direction by a plurality of intermediate backside patches, and an outer backside patch surrounding the plurality of intermediate backside patches, wherein:

the center backside patch and the plurality of intermediate backside patches arranged in a pattern that provides circular symmetry with respect to a center of the antenna;

the plurality of intermediate backside patches are each isolated from adjacent ones of the plurality of intermediate backside patches by a space;

the outer backside patch extends radially outward to an outer edge of the outward protruding portions of the substrate and extends radially inward from an outer edge of the recessed portions of the substrate; and each portion of the outer backside patch that extends to the outer edge of one of the outward protruding portions is positioned radially outward from one of the spaces between adjacent ones of the plurality of intermediate backside patches; and a cavity coupled to the substrate.

2. The antenna of claim 1 wherein the outer backside patch has a ring-shape that extends around the plurality of intermediate backside patches, and the outer backside patch is not circular symmetric with respect to the center of the antenna.

3. The antenna of claim 1 wherein each of the plurality of intermediate backside patches that are disposed opposite an impedance transformer provide a ground pad for the impedance transformer, and others of the plurality of intermediate backside patches are electrically floating.

4. The antenna of claim 1 wherein the outer backside patch is coupled to an upper portion of the cavity.

5. The antenna of claim 1 wherein the outer backside patch extends radially to an outer edge of the substrate in some areas and is isolated from the outer edge of the substrate in other areas, wherein portions of the outer backside patch that extend to the outer edge of the substrate are directly coupled to the cavity and portions of the outer backside patch that are isolated from the outer edge of the substrate are not directly coupled to the cavity.

6. The antenna of claim 1 wherein the frontside patch is electrically coupled to the cavity by a connector.

7. The antenna of claim 1 wherein a portion of the plurality of intermediate backside patches are each coupled to a ground of the one or more antenna feeds.

8. The antenna of claim 1 wherein the substrate includes outward protruding portions and recessed portions, the plurality of intermediate backside patches are each isolated from adjacent ones of the plurality of intermediate backside patches by a space, and wherein the outward protruding portions of the substrate are positioned radially outward from one of the spaces between adjacent ones of the plurality of intermediate backside patches.

9. The antenna of claim 1 wherein the frontside patch includes one or more elongated sections extending radially outward from the frontside patch, each of the one or more elongated sections being coupled to an output of a corresponding microstrip, and each microstrip being disposed radially outward beyond an end of an associated one of the one or more elongated sections.

10. An antenna configured to receive global navigation satellite (GNSS) signals, comprising:

a substrate having a front side and a backside opposite the front side;

a frontside patch arranged on the front side of the substrate, the frontside patch configured as a radiating element;

one or more antenna feeds electrically coupled to the frontside patch;

a metamaterial ground plane comprising:

a plurality of backside patches arranged on the backside of the substrate and separated from the frontside patch by the substrate, wherein the plurality of backside patches include a center backside patch surrounded in a radial direction by a plurality of intermediate backside patches, the center backside patch and the plurality of intermediate backside patches arranged in a pattern that provides circular symmetry with respect to a center of the antenna, and wherein a diameter of the center backside patch is different from a radial width of each of the plurality of intermediate backside patches; and a cavity coupled to the substrate.

11. The antenna of claim 10 wherein each of the plurality of intermediate backside patches are electrically isolated from the cavity.

12. The antenna of claim 10 wherein the plurality of intermediate backside patches are surrounded by an outer backside patch having a ring-shape that extends around the plurality of intermediate backside patches, and wherein the outer backside patch is not circular symmetric with respect to the center of the antenna.

13. The antenna of claim 10 wherein the plurality of intermediate backside patches are surrounded in a radial direction by an outer backside patch, and wherein the outer backside patch is electrically coupled to the cavity.

14. The antenna of claim 10 wherein the plurality of intermediate backside patches are each isolated from adjacent ones of the plurality of intermediate backside patches by a space.

15. The antenna of claim 10 wherein:

an outer edge of the substrate includes outward protruding portions and recessed portions, the plurality of intermediate backside patches are each isolated from adjacent ones of the plurality of intermediate backside patches by a space, and an outer backside patch surrounds the plurality of intermediate backside patches and extends radially outward to an outer edge of the outward protruding portions of the substrate and extends radially inward from an outer edge of the recessed portions of the substrate, and wherein each portion of the outer backside patch that extends to the outer edge of one of the outward protruding portions is positioned radially outward from one of the spaces between the adjacent ones of the plurality of intermediate backside patches.

16. An antenna configured to receive global navigation satellite system (GNSS) signals, comprising:

a substrate;

a frontside patch arranged on a front side of the substrate;

one or more impedance transformers arranged on a front side of the substrate, each of the one or more impedance transformers coupled to an input feed and coupled to the frontside patch at an output; and a metamaterial ground plane comprising:

a plurality of backside patches arranged on a backside of the substrate and separated from the frontside patch by the substrate, the plurality of backside patches including a center backside patch surrounded in a radial direction by a plurality of intermediate backside patches, and an outer backside patch surrounding the plurality of intermediate backside patches, wherein the center backside patch is separated from each of the plurality of intermediate backside patches by a first space, and each of the intermediate backside patches are separated from adjacent ones of the intermediate backside patches by a second space, and wherein the first space between the center backside patch and each of the plurality of intermediate backside patches is greater than the second space between adjacent ones of the plurality of intermediate backside patches; and a cavity coupled to the substrate.

17. The antenna of claim 16 wherein an outer edge of the substrate includes outward protruding portions and recessed portions, the outer backside patch extending radially outward to an outer edge of the outward protruding portions of the substrate and extending radially inward from an outer edge of the recessed portions of the substrate, and wherein portions of the outer backside patch that extend radially inward from the outer edge of the recessed portions are each separated from an adjacent one of the plurality of intermediate backside patches by a third space that is greater than the first space.

18. The antenna of claim 16 wherein an outer edge of the substrate includes outward protruding portions and recessed portions, the outer backside patch extending radially outward to an outer edge of the outward protruding portions of the substrate and extending radially inward from an outer edge of the recessed portions of the substrate, and wherein portions of the outer backside patch that extend radially inward from the outer edge of the recessed portions are separated from one another by a fourth space that is greater than the second space.

19. The antenna of claim 16 wherein an outer edge of the substrate includes outward protruding portions and recessed portions, the outer backside patch extending radially outward to an outer edge of the outward protruding portions of the substrate and extending radially inward from an outer edge of the recessed portions of the substrate, and wherein portions of the outer backside patch that extend radially outward to the outer edge of the outward protruding portions and portions of the outer backside patch that extend radially inward from the outer edge of the recessed portions are coupled directly to the cavity.

* * * * *